US007000282B2

(12) United States Patent
Cox et al.

(10) Patent No.: US 7,000,282 B2
(45) Date of Patent: Feb. 21, 2006

(54) SPRING-BIASED PIVOTING SQUEEGEE

(75) Inventors: Grant Cox, Windsor, CA (US); Nicholas Talesfore, Los Gatos, CA (US); Joseph McArdle, Mountain View, CA (US)

(73) Assignee: Ettore Products Co., Oakland, CA (US)

( * ) Notice: Subject to any disclaimer, the term of this patent is extended or adjusted under 35 U.S.C. 154(b) by 0 days.

(21) Appl. No.: 10/842,875

(22) Filed: May 10, 2004

(65) Prior Publication Data

US 2004/0226126 A1 Nov. 18, 2004

Related U.S. Application Data

(63) Continuation-in-part of application No. 10/439,852, filed on May 15, 2003, now Pat. No. 6,931,690.

(51) Int. Cl.
*A47L 1/06* (2006.01)

(52) U.S. Cl. ..... 15/245; 15/143.1; 15/144.1; 16/430

(58) Field of Classification Search ..... 15/245, 15/143.1, 145, 144.1, 117, 121, 236.01, 245.1; 16/430; 30/329, 335, 336, 337, 338, 330, 30/331, 169
See application file for complete search history.

(56) References Cited

U.S. PATENT DOCUMENTS 731,338 A * 6/1903 Cattelle ..... 15/245
742,590 A * 10/1903 Cattelle ..... 15/245
2,440,099 A * 4/1948 Kind ..... 15/245
3,892,005 A * 7/1975 Berns ..... 15/245
4,124,915 A * 11/1978 Schlicher ..... 15/105
4,336,624 A * 6/1982 Pichelman et al. ..... 15/245
4,697,296 A * 10/1987 Smahlik ..... 15/245
4,777,694 A * 10/1988 Young ..... 15/245
4,847,938 A * 7/1989 Unger ..... 15/245
4,941,228 A * 7/1990 Belanger et al. ..... 15/245

(Continued)

*Primary Examiner*—Gary K. Graham
(74) *Attorney, Agent, or Firm*—Brian Beverly

(57) ABSTRACT

A spring-biased pivoting squeegee 10 provides a head 12 pivotally attached to a handle 16. The head 12 is movable between a rest position, in which the head 12 is angularly displaced from the handle 16, and a biased position in which the head 12, handle 16, and wiping blade 14 are in linear relation. In the biased position, the wiping blade is maintained at an optimum angle for cleaning a glass surface even with the handle 16 held generally perpendicular to the glass. A spring 60 is fully contained in the head 12 and biases the head toward the rest position. A tension adjustment knob 80 in the head 12 permits adjustment of the spring 60 to a tension level according to the ergonomic requirements of a user. In a second embodiment of the invention an improved locking mechanism comprises a pivoting lock lever 260 held against the top wall 262 of a recess 264 in the head 202 of the squeegee by a retainer 278. The lock 260 is movable between locked and released positions. In the locked position stop surfaces 276 on the lock lever abut with upward facing ledges 256 of side plates 250 on the forward portion of the main handle body 208 to lock the head 202 in the biased position. Two springs 306 have forward projections 308 which rest in downwardly biased engagement on a spring pull nut 304. The spring pull nut 304 is adjustable by turning an adjustment knob 294 to modify the tension on the springs. Slip-resistant surfaces on the handle 208 and head 202 improved handling of the squeegee.

26 Claims, 15 Drawing Sheets

U.S. PATENT DOCUMENTS 4,993,101 A * 2/1991 Newman et al. ..... 15/245
5,175,902 A * 1/1993 Samuelsson ..... 15/245
5,369,841 A * 12/1994 Bembnowski ..... 16/278
5,930,863 A * 8/1999 Samuelsson ..... 15/245
6,298,516 B1 * 10/2001 Beals et al. ..... 15/143.1
6,601,272 B1 * 8/2003 Stvartak et al. ..... 16/430

* cited by examiner

SPRING-BIASED PIVOTING SQUEEGEE

This application is a continuation in part of application Ser. No. 10/439,852 filed May 15, 2003, now U.S. Pat. No. 6,931,690.

FIELD OF THE INVENTION

This invention relates generally to squeegees and in particular to a squeegee having a head, handle and wiping blade which can be moved into general linear relation for cleaning glass surfaces, even surfaces located in recessed corners.

DESCRIPTION OF THE PRIOR ART

Squeegees are widely used to clean windows quickly and effectively. Generally the cleaning process begins with wetting the window surface with water or a cleaning solution. The squeegee is then used to wipe off the water or cleaning solution and any accumulated dirt or dust leaving the window surface clean. When performed expertly, a movement sometimes known as the "butterfly stroke" is used in which the squeegee's wiping blade is initially placed along the edge of one corner of the window; then the entire surface of the window is wiped off in a continuous back-and-forth swirling motion from the top to the bottom of the window without removing the wiping blade from the surface, finishing the motion by drawing the blade to the edge of another corner. With practice, this motion can be performed with considerable efficiency. When numerous windows are to be cleaned at one time, such as all the windows in a large office building or, increasingly, in many residential applications, proficient cleaning of each window becomes important.

With long experience it has been found that the wiping blade will most effectively wipe a surface clean if it is maintained within a relatively narrow range of acute angles relative to the surface. Failure to swipe the surface at an optimal angle within that range will lead to streaking and visibly unsatisfactory results. In order to comfortably handle the squeegee and maintain the wiping blade at an optimal angle, squeegees are typically constructed with the blade mounted at an angle relative to the handle of the squeegee, as indicated in U.S. Pat. No. 2,123,638, issued to Ettore Steccone in 1938. More precisely, the blade is mounted on a head which is generally in planar alignment with the blade, and the head is angularly displaced relative to the handle. However, this conventional construction creates a problem when cleaning recessed windows.

A common architectural feature calls for windows to be recessed into a window frame or to be set immediately adjacent to a perpendicular wall. If the window is recessed more than a few inches, or set next to a wall, wiping off the entire window in a continuous stroke as described above may not be possible, because the handle will butt against the adjacent window frame or wall. When this happens, the conventional practice is to wipe the small section of window clean with a cloth. Alternatively, the window cleaner may remove the squeegee from the window, wipe the blade clean, reposition the squeegee so that the blade may be applied again to the window edge adjacent the frame or wall, and then finish wiping the window clean with a second stroke. Either alternative is less efficient than wiping a window clean in a single continuous motion and may produce streaking.

A variation of the problem arises when cleaning windows using a squeegee mounted on a pole. Poles are used whenever the height of the window is great enough that it cannot be reached easily without a pole. Typically cleaning a tall window with a squeegee mounted on a pole involves performing several vertical strokes starting from the top of the window moving down to the bottom. If the bottom of the window is near ground level, the angle of the squeegee to the handle makes it impossible to hold the wiping blade at an optimal cleaning angle relative to the window surface. Therefore, the squeegee must be removed from the window and the window cleaner must move to a new position which permits the squeegee to be reapplied at a proper angle to the window, or the bottom of the window must be finished with close-up work using a hand-held squeegee.

One attempt to solve this problem is described in U.S. Pat. No. 5,175,902 to Samuelsson, which discloses a squeegee device including a squeegee blade mount which is pivotally attached to and disposed between the distal ends of a pair of laterally spaced apart fingers extending from a distal end of a fitting. A handle is attached to the other end of the fitting. A U-shaped kicker arm is carried on the back side of the mount. A squeegee blade is held on the front side of the mount. The mount is biased to a normal position by a pair of springs extending between the kicker arm and the pair of fingers. When the squeegee blade is drawn along the surface of a window, as it approaches an abutting wall, window frame or window ledge, the kicker arm engages the abutment and orbits the mount, consequently driving the blade through an arc relative to the handle and thereby accelerating movement of the wiper blade to complete the stroke in the direction of the abutment. Although Samuelsson reorients the wiper blade with respect to the handle, the device appears to be workable only on windows that are not deeply recessed. The reorientation of the blade to the handle also may cause an undesirable reduction in the cleaning effectiveness of the squeegee blade as it passes through the accelerating movement. Another practical difficulty is that the kicker arm, mount, and dual fingers project from the otherwise generally contained outline of the squeegee and may interfere with or become tangled up in other equipment. Finally, the device is not contained within the body of a standard squeegee; it is a separate device that must be specially mounted to the head of a squeegee and adds another item to the inventory of equipment that a window washer must carry.

There is therefore a need for an improved squeegee that maintains the angle of the wiping blade to the glass in a recessed window or a window directly adjacent to a wall, in which the outline of the device is generally smooth and uncluttered.

SUMMARY OF THE INVENTION

A spring-biased pivoting squeegee provides a wiping blade transversely mounted on the forward portion of the head of a squeegee. A handle is pivotally attached to a back portion of the head about a pivot pin which forms an axis parallel to the wiping blade. The head is movable relative to the handle about the pivot pin between a rest position and a biased position. In the rest position the head is angularly displaced relative to the handle at an angle which positions the head and wiping blade at an angle conventionally found in prior art squeegees. In the biased position the head is in linear disposition with the handle thus positioning the wiping blade, head, and handle in general planar relation.

A spring having dual coils, both of which are looped around the pivot pin which joins the handle and head, is fully contained inside the head of the squeegee. Rearward projections of the spring are biased against an internal wall of the handle, and a U-shaped projection extending forward from the pivot pin into the head biases the head toward the rest position. The spring is set at a tension such that, under normal usage, the head and, hence, the wiping blade, are maintained at an angle relative to the handle; however, the tension is low enough such that, without ever removing the blade from contact with the glass surface, the head and wiping blade may be moved to the biased position by pressing down on the handle. Preferably the head and handle are provided with slip-resistant inserts on the head for gripping by the thumb and an opposing finger, and on the handle for gripping by the palm of the hand and fingers wrapped around the handle, to facilitate movement of the head between the biased and rest positions. The handle and head are prevented from over-pivoting beyond planar configuration by abutting surfaces which are brought into mutual contact when the head is moved into the biased position.

A recessed locking lever is pivotally attached to the squeegee head. The locking lever is movable about an axis generally perpendicular to the squeegee head between a locking position and an unlocked position. In the locking position, the lever is in abutting disposition with a stop on the handle. Pressure from the spring urges the lever and stop together, effectively locking the head and handle in the biased position. The pressure may be relieved by bringing slight backwards pressure against the head whereupon the lever may be rotated into the unlocked position where it is free of any obstructions, thus permitting the head to pivot back to the rest position.

A tension adjustment mechanism permits the spring tension to be adjusted to different pressure levels. A tension adjustment knob is provided on the upper surface of the squeegee head. The tension adjustment knob has a barrel fitting which sits in a well in the head to retain a knurled top portion above the upper surface of the head for manipulation by hand, A linear projection extends from the barrel fitting into the head and is in threaded engagement with a square tension adjustment nut disposed in a rectangular internal shaft in the head. As the knob is turned the nut is prevented from rotating by the walls of the rectangular shaft. Therefore, rotation of the knob moves the nut up and down in the shaft. The U-shaped projection of the spring is disposed around the linear projection and interposed between the tension adjustment knob and the tension adjustment nut. Thus, by rotating the tension adjustment knob, the U-shaped projection of the spring is lowered or raised in the head by the tension adjustment nut which adjusts the spring to a tension level suited to the ergonomic requirements of the user.

In a second embodiment of the invention the locking mechanism is modified. A forward portion of the handle has two integral spaced apart generally parallel side plates in concentric relation to the pivot pin. Each side plate includes an arcuate recessed portion, the lower part of which defines an upward facing ledge. A generally square-shaped lock lever is disposed in downward dependency from the top wall of a downward facing recess in the head of the squeegee. The lock lever is comprised of a cylindrical crossbar, a pair of legs depending from the crossbar, and a bridge extending between the legs opposite the crossbar, the bridge, legs and crossbar defining an intermediate opening. Each leg has a laterally extending base portion adjacent the crossbar including a stop surface facing downward and away from the top wall of the recess. The crossbar of the lock lever is held in pivotable disposition against the top wall by a retainer so that the lock lever is free to pivot about the crossbar between a locked position and a released position. In the locked position, with the head of the squeegee in the biased position relative to the handle, the base portions of the legs are interposed between the top wall of the recess and the upward facing ledges of the side plates thus disposing the stop surfaces of the base portions against the ledges of the side plates to prevent the head from rotating from the biased position to the rest position. Pivoting of the lock lever to the released position moves the base portions sufficiently to release the head to pivot to the rest position.

The retainer is generally planar and has a forward edge, two side edges orthogonal to the forward edge spanning the width of the retainer, and an upward opening channel opposite the forward edge. A forward flange and two side flanges orthogonal to the forward flange depend downwardly from the top wall of the recess, the side flanges spaced apart by the width of the retainer. Each of the flanges has an inwardly extending tab that is downwardly spaced from the top wall. The forward edge of the retainer is held against the forward flange between the top wall and the tab on the forward flange. Similarly, the side edges of the retainer are held against the inner edges of the side flanges between the top wall and the tabs on the side flanges. The retainer is thus held against the top wall between the forward and side flanges. The crossbar of the lock lever is held in the retainer's channel against the top wall of the recess.

An adjustment knob is rotatably disposed on the top surface of the head. A post depending from the knob is disposed and freely rotatably in a hole in the top of the head and in an aperture in the retainer in concentric alignment with the hole. A spring pull nut is threadedly attached to the post such that rotation of the adjustment knob moves the spring pull nuts towards or away from the adjustment knob. The retainer is prevented from being rotating in its plane by the post due to the tight disposition of its forward and side edges against the forward and side flanges of the top wall. In this embodiment two springs are coiled around the axis post. A forward projection extends from each spring through the opening in the locking lever. The distal end of each spring is downwardly hooked and sits in downwardly biased engagement in oppositely disposed depressions in the spring pull nut laterally of the post. The spring tension is thus adjustable by rotation of the adjustment knob which raises and lowers the distal ends of the spring according to a desired comfort level.

A spring-biased pivoting squeegee according to the invention can be used in the same manner as a prior art squeegee would be used in most situations. Improved performance is realized when cleaning recessed windows. As the squeegee is drawn across the window toward an abutting wall or window frame, the window washer may cause the head to move into the biased position by simultaneously pressing down on the wiping blade and forward on the handle, never removing the wiping blade from the surface of the glass. Since the wiping blade, head, and handle are all in planar disposition, the wiping motion can be continued toward the abutting wall or frame member to the edge of the glass, rather than having to remove the wiping blade from and then reapply it to the glass. Thus, an entire recessed window may be cleaned in a single continuous motion with a high degree of proficiency, leading to substantial time savings in the cleaning project, eliminating the need to use additional cleaning implements, and reducing fatigue.

An added benefit of the invention relates to the angle of the wiping blade to the glass. By maintaining the wiping blade of a squeegee at a slight angle to the perpendicular relative to the glass, the cleaning performance of the blade is superior. Therefore, the best squeegees include a slight curvature in the wiping blade mount which maintains the blade at an optimum cleaning angle. Generally, when cleaning a glass surface with a squeegee, an effort is made to hold the squeegee so that the wiping blade is retained at the optimum cleaning angle. The present invention enables the optimum cleaning angle to be retained as the squeegee is moved toward the abutting wall or frame of a recessed window, because the angle of the squeegee head to the window can be maintained by easily altering the angle of the head to the handle. The ease in adjusting the angle allows improved performance through a range of positions and provides ergonomic benefits to the user. Even at the extreme edge of a recessed window or in difficult to reach positions, the invention preserves the optimum cleaning angle and the safety of the window washer.

BRIEF DESCRIPTION OF THE ILLUSTRATIONS

Figure 7A:
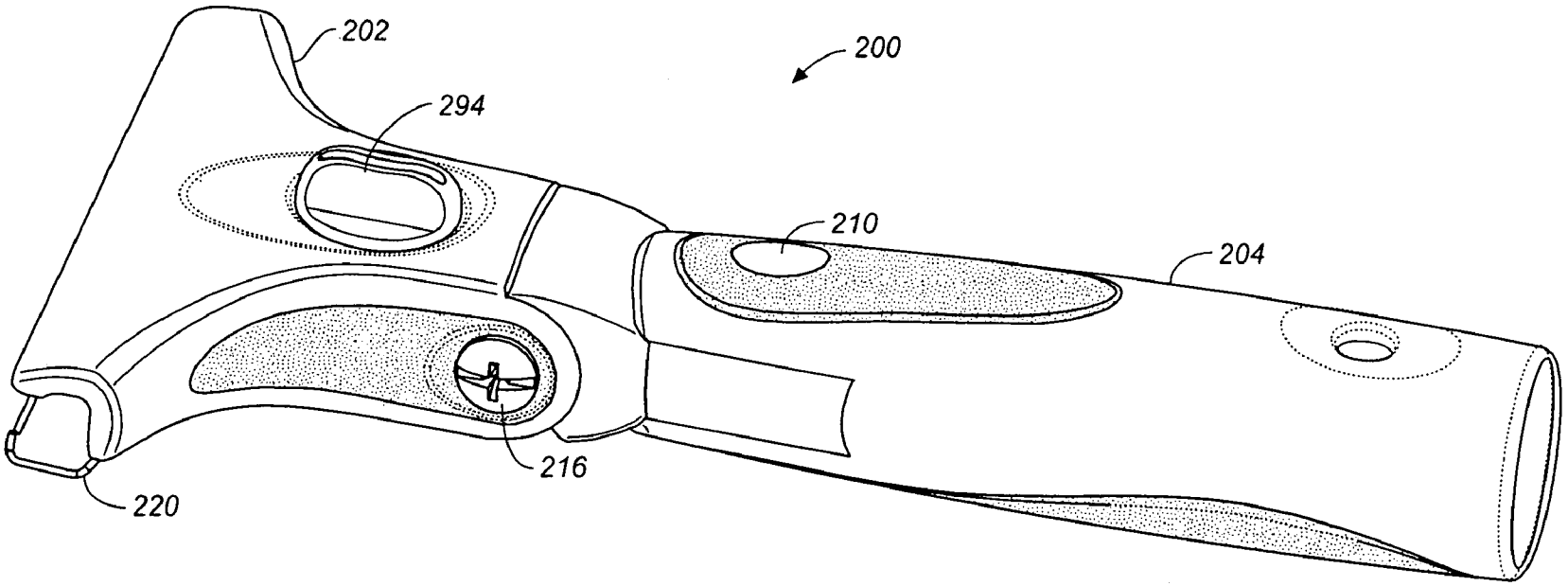
FIG. 7A is a perspective view of the spring biased pivoting squeegee according to the invention showing the head in the biased position relative to the handle.
Figure 9A:
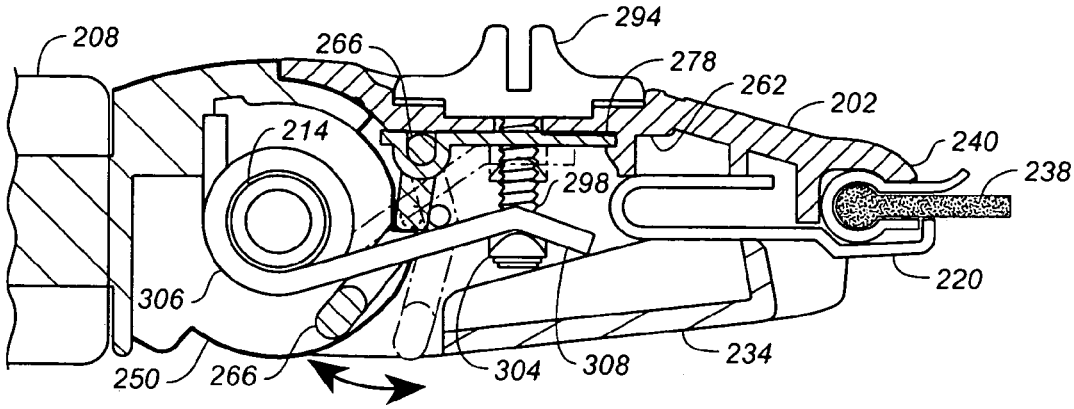
Figure 9B:
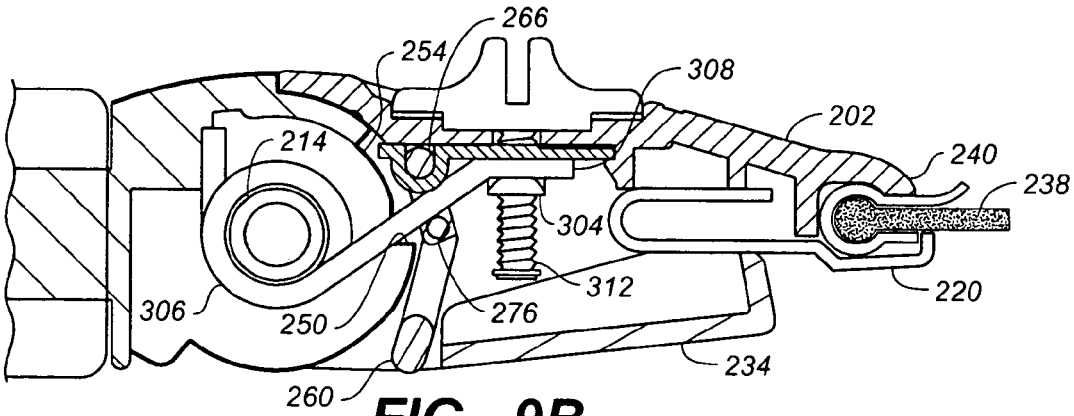
Figure 9C:
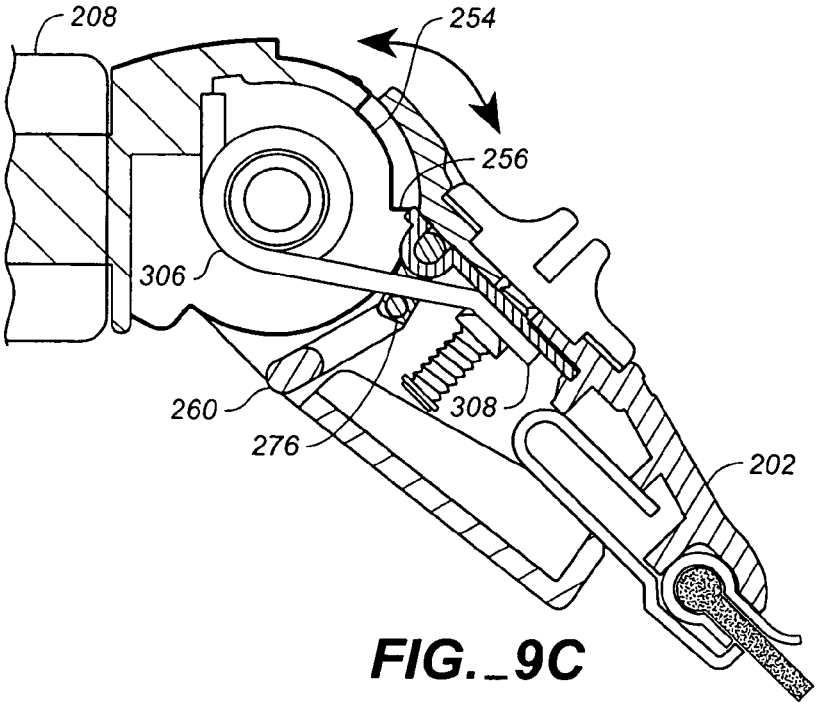

FIGS. 9A–9C are sectional views of the squeegee shown in FIG. 7A, FIG. 9A showing the moving of the lock lever between the lock and released positions as indicated by the arrows, and showing movement 9B showing the springs in a lower position and in a higher position indicated by the broken lines, FIG. B showing the lock lever in the release position, and the forward projections of the springs in raised position to increase tension on the spring, and FIG. 9C showing the head in the rest position relative to the handle, the arrows indicating movement of the head between the biased and rest positions.

Figure 10A:
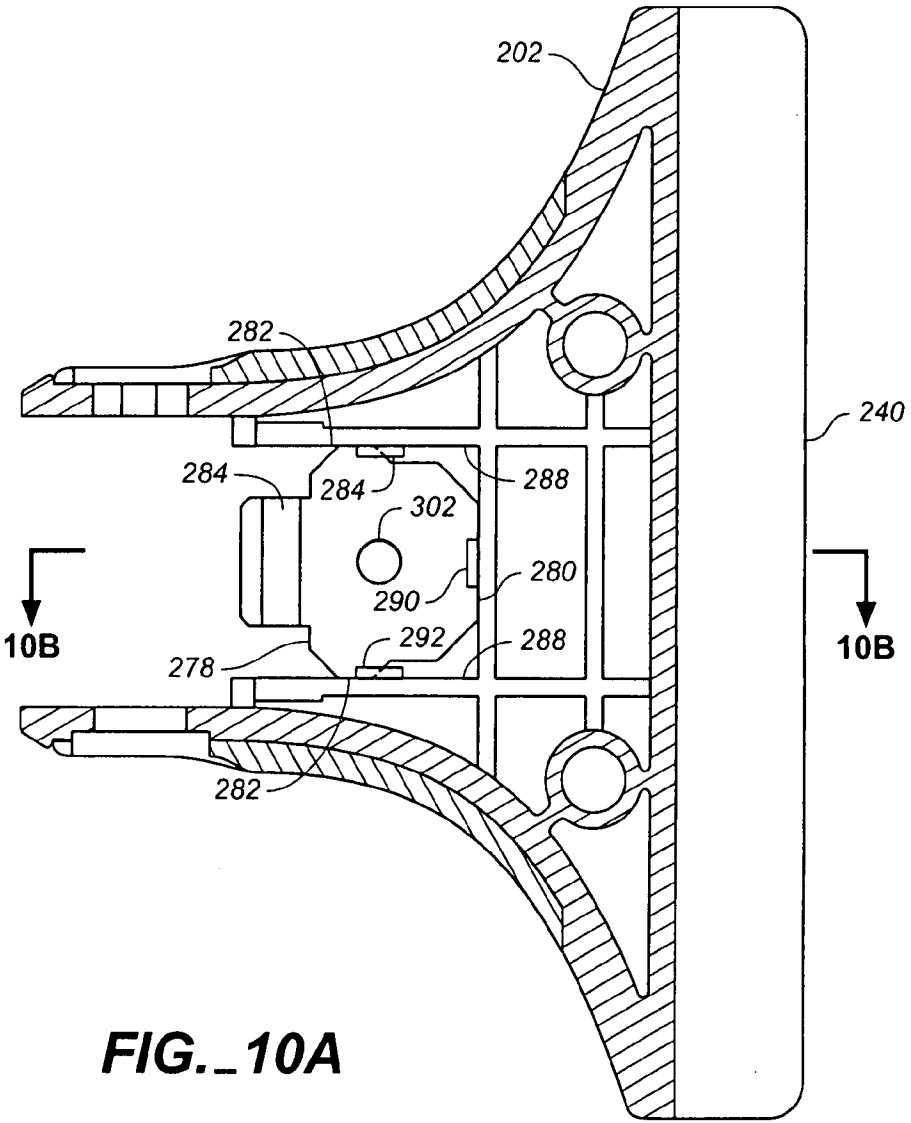

FIG. 10A is an enlarged sectional bottom view of the head of the squeegee shown in FIG. 7A showing the retainer inserted between the forward and side flanges of the head.

Figure 10B:
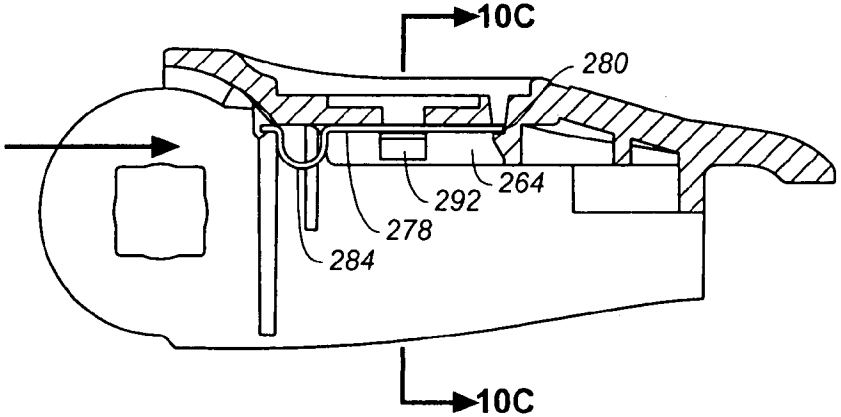
Figure 10C:
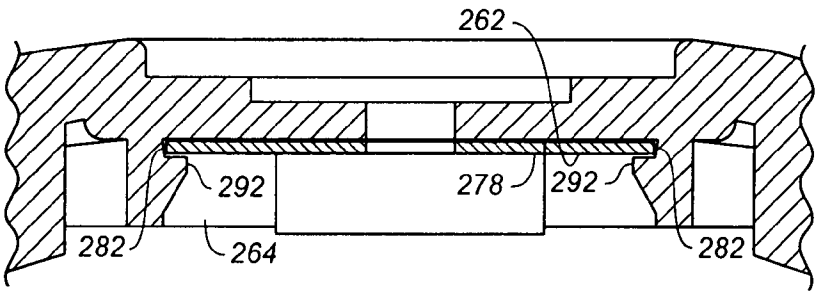

FIG. 10B is a side sectional view of the head shown in FIG. 10A taken along lines 10B—10B. FIG. 10C is forward sectional view of the head shown in FIG. 10B taken along lines 10C—10C.

Figure 11B:
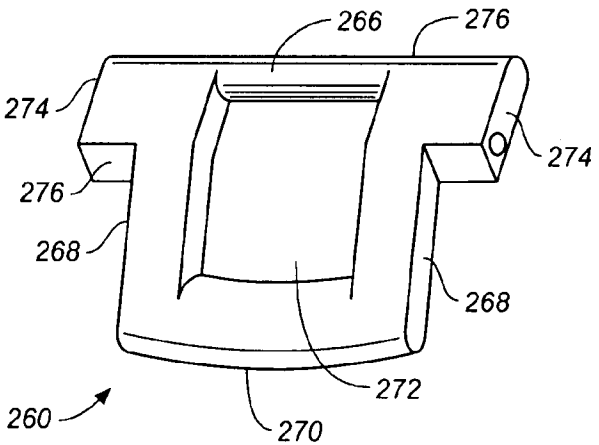
Figure 11A:
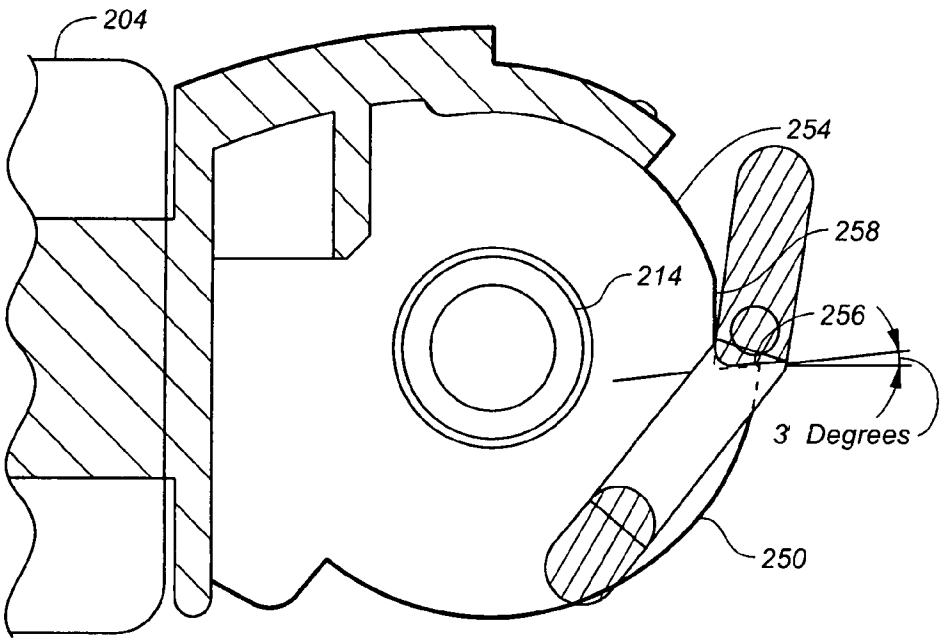

FIG. 11A is a side sectional view of the knuckle of the handle showing a close-up of one of the side plates of the knuckle and indicating a slight inclination of the upward facing ledge on the forward portion of the side plate.

FIG. 11B is a perspective view of the lock lever of the invention.

Figure 12B:
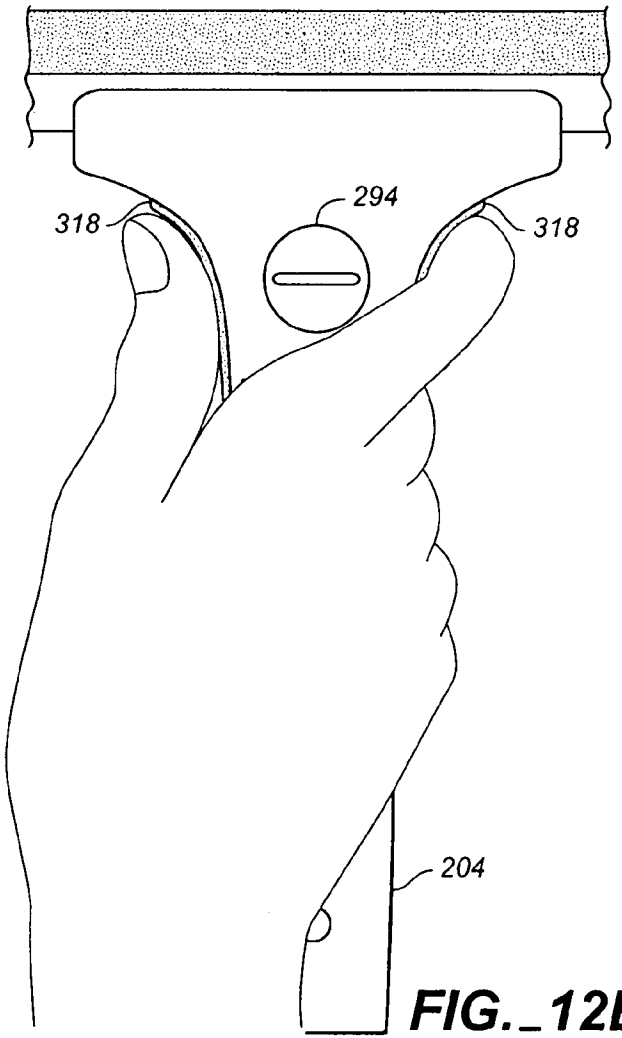
Figure 12A:
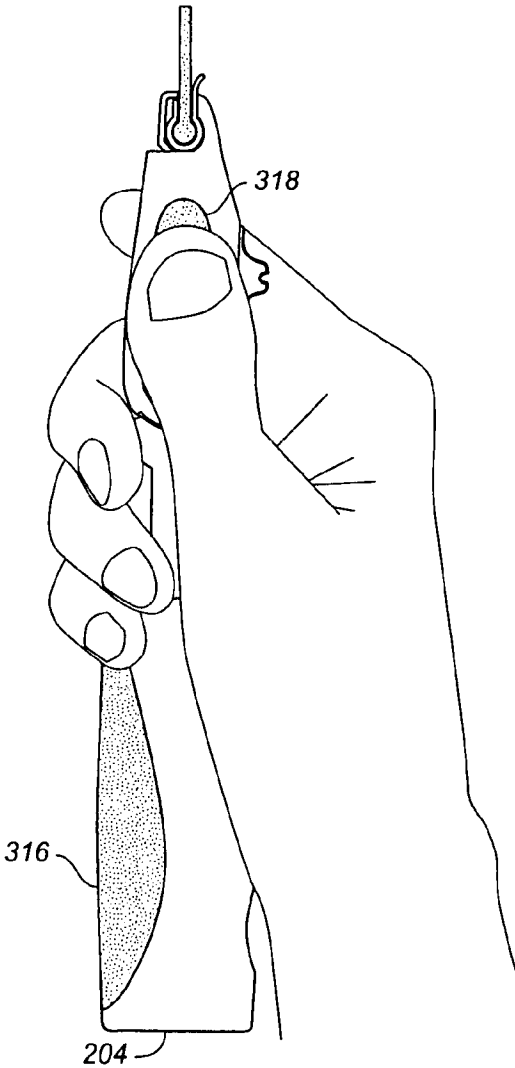

FIGS. 12A and 12B are side and top views respectively of the squeegee shown in FIG. 7A being held by a hand in a typical manner during use.

DETAILED DESCRIPTION OF THE ILLUSTRATED EMBODIMENT

A spring-biased pivoting squeegee 10 is now described in relation to the illustrations according to the invention. A spring-biased pivoting squeegee 10 comprises a head 12 to which is mounted a wiping blade 14 and a handle 16. The head 12 has a generally planar geometry, a back portion 18, and a forward portion 20. The wiping blade 14 is mounted on the forward portion 20 generally transversely to the head.

Figure 1B:
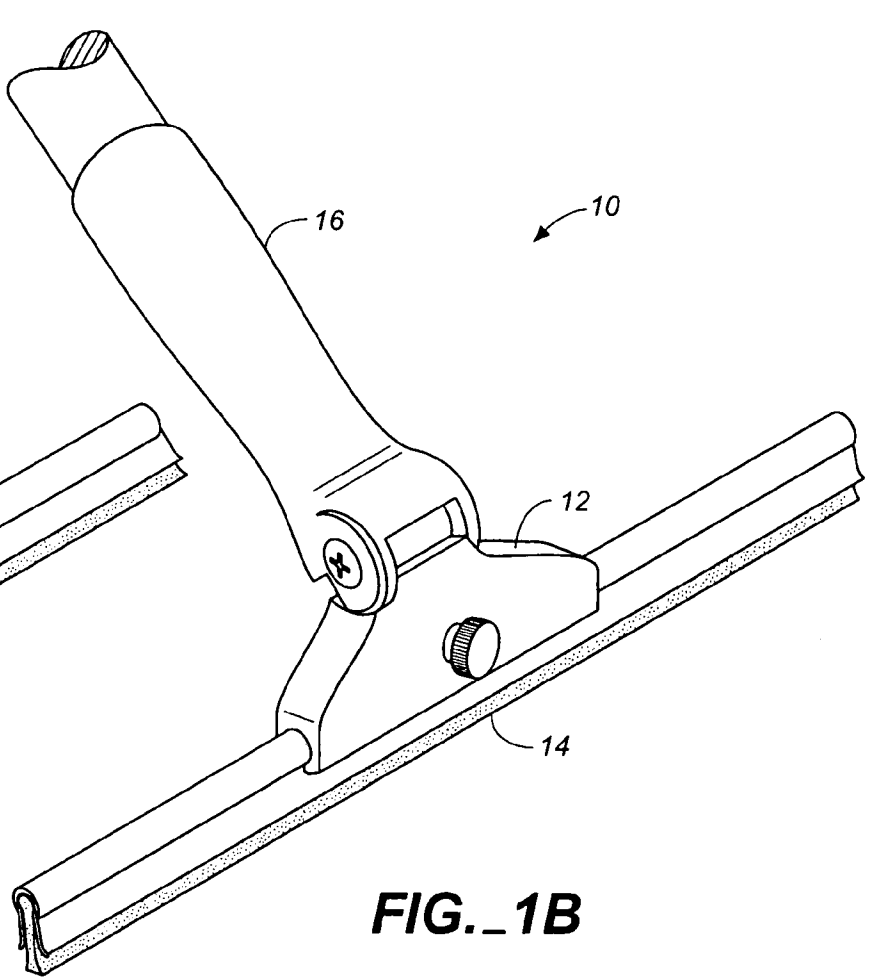
FIG. 1B is a top perspective view of the pivoting squeegee of FIG. 1A, but showing the head in the rest position relative to the handle.
Figure 1A:
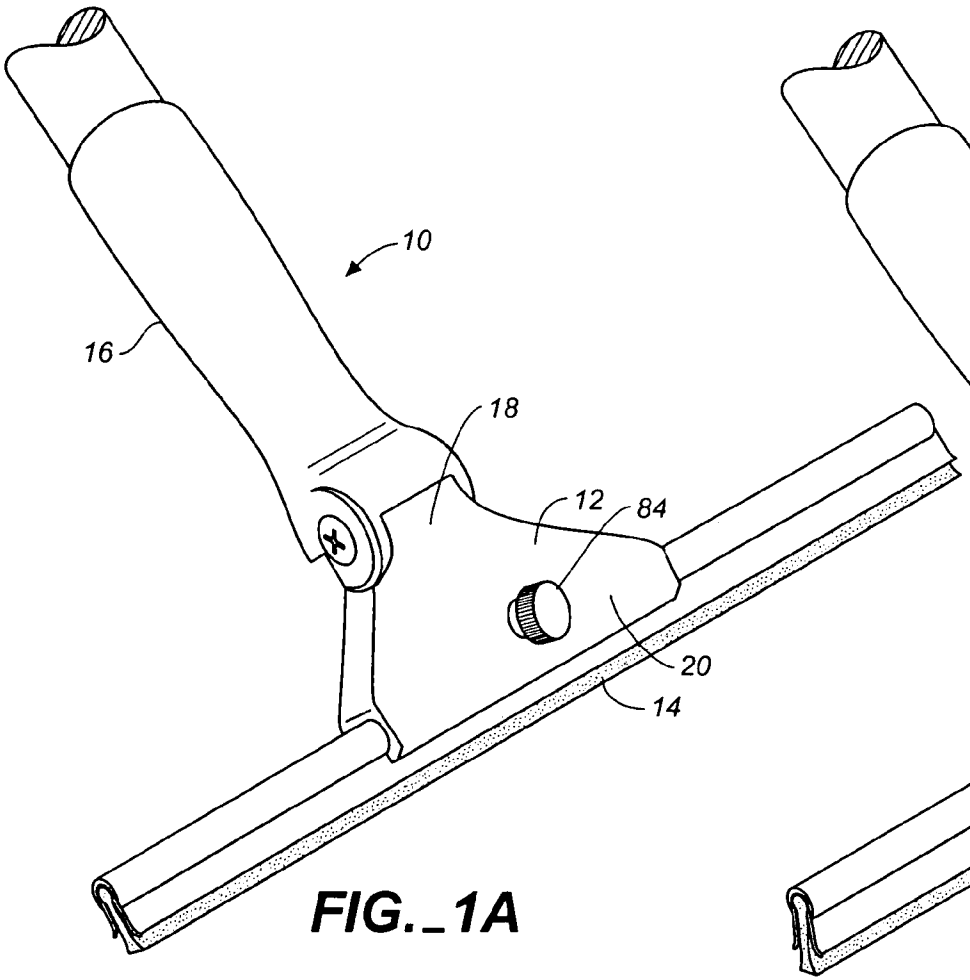
FIG. 1A is a top perspective view of a spring-biased pivoting squeegee according to the invention showing the head in the biased position relative to the handle.
Figure 2B:
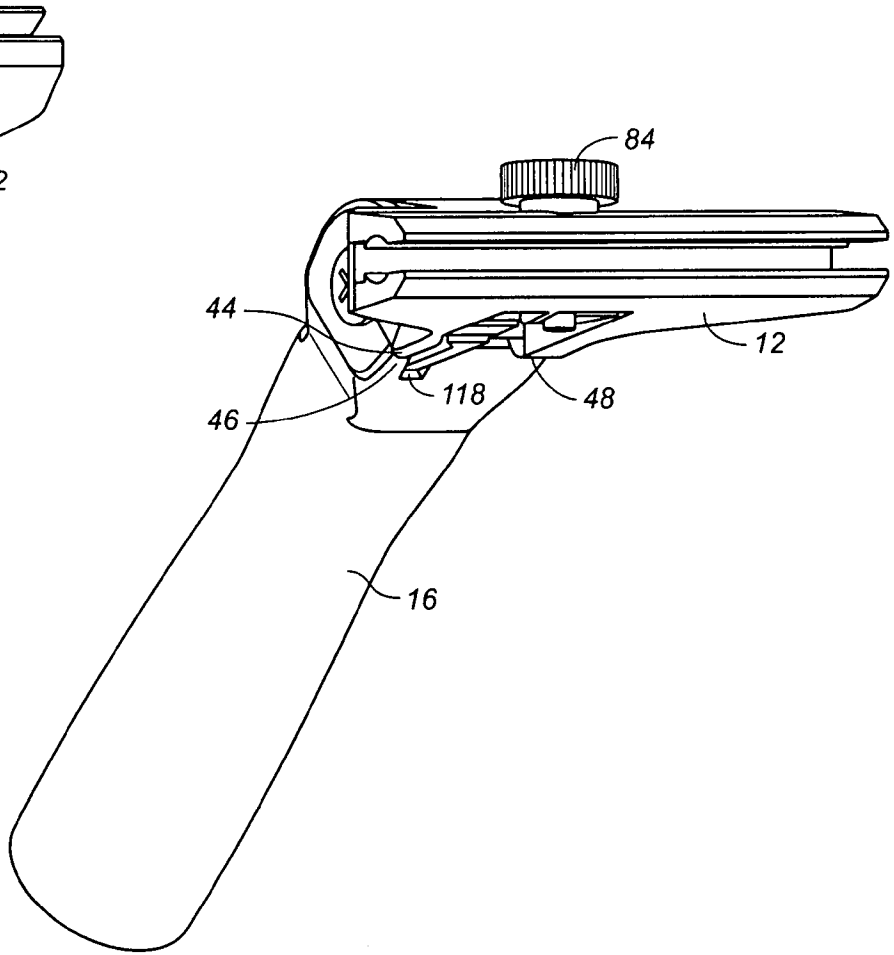
FIG. 2B is a bottom perspective view of the pivoting squeegee shown in FIG. 2A, but with the head in the rest position relative to the handle.
Figure 2A:
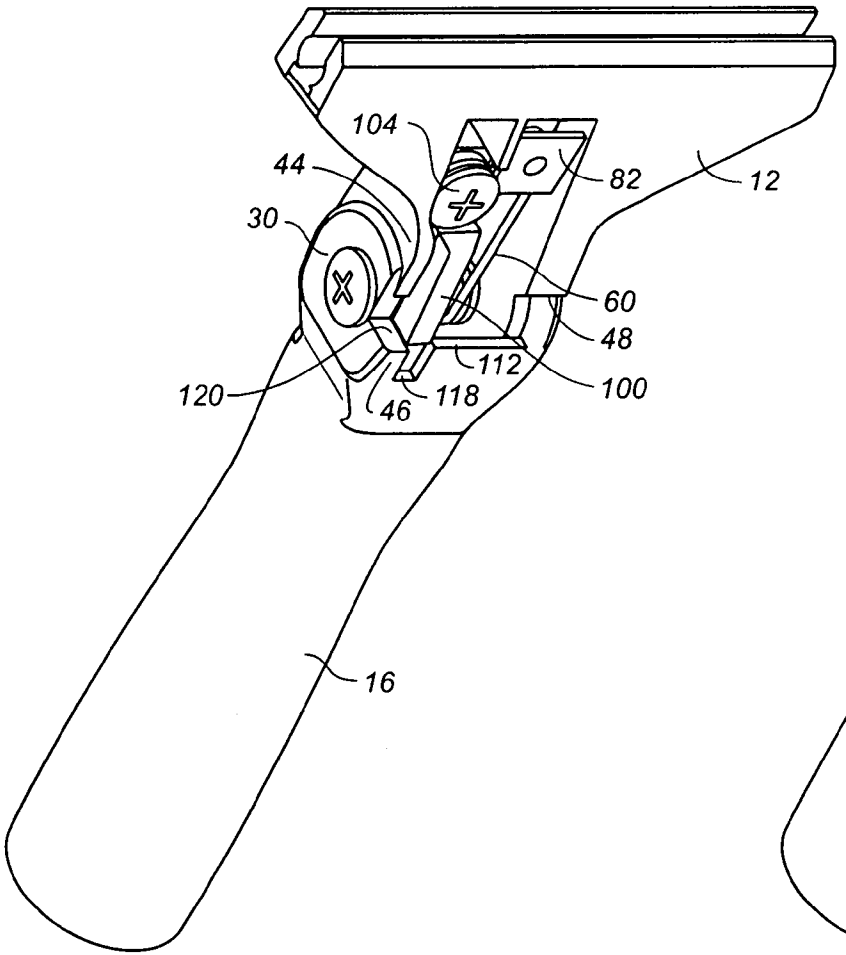
FIG. 2A is a bottom perspective view of the invention with the wiping blade removed, and showing the head in the biased position relative to the handle and the locking lever in the unlocked position.
Figure 2C:
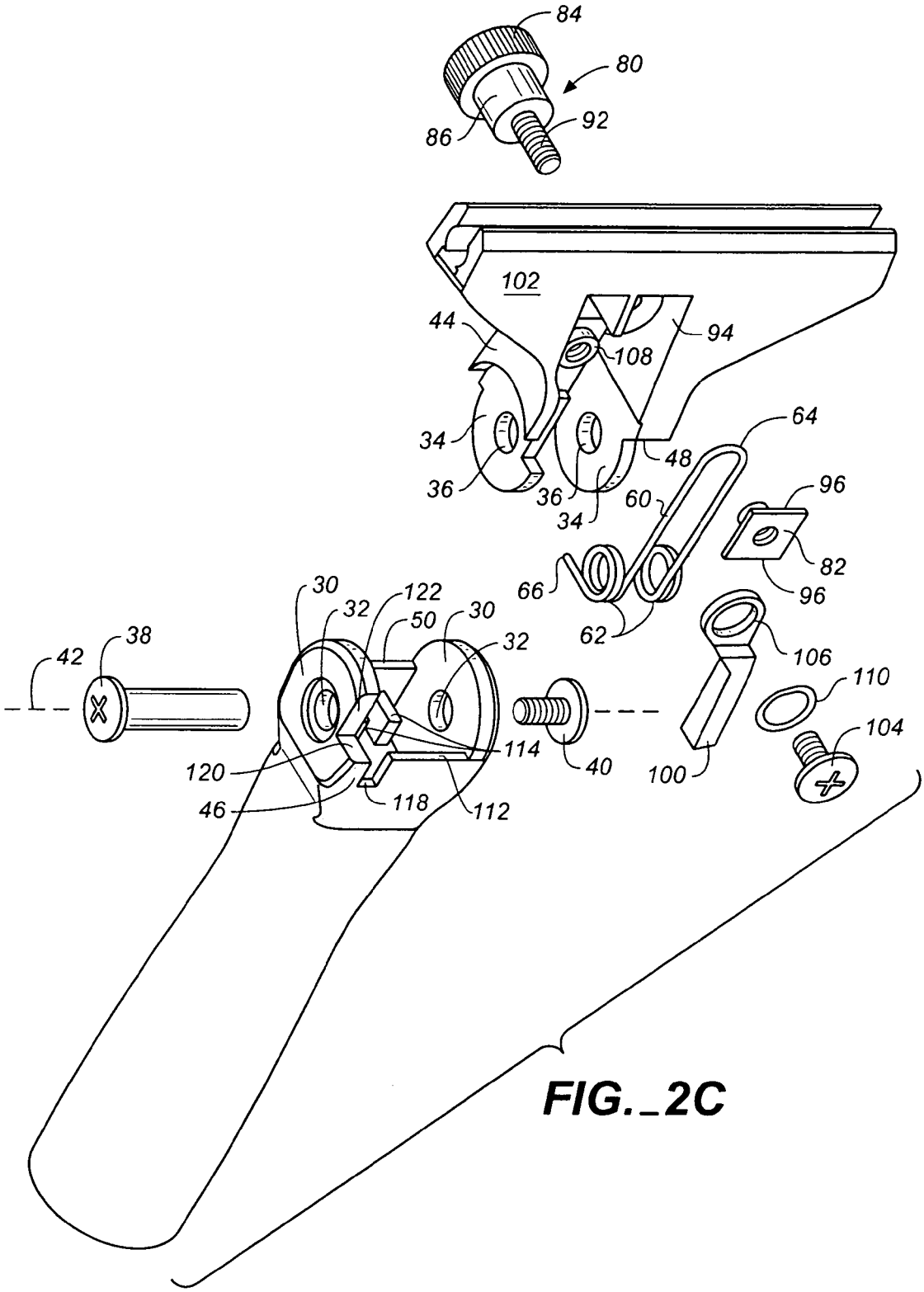
FIG. 2C is an exploded perspective view of a spring-biased pivoting squeegee according to the invention.

The front part of the handle 16 is provided with generally hemispherical forward projecting outer plates 30 each having a center aperture 32, best seen in FIG. 2C. The back portion of the head is provided with generally hemispherical rear projecting inner plates 34 disposed generally perpendicular to the head, each having a center opening 36. When the invention is fully assembled, the inner plates 34 on the head 12 fit cooperatively within and in concentric alignment with the outer plates 30 of the handle such that the center apertures 32 and center openings 36 are in axial alignment. A barrel nut 38 and screw 40, when assembled and inserted in the center apertures 32 and center openings 36, form a hinge for pivotal attachment of the handle 16 and head 12 around an axis 42 which is parallel to the wiping blade.

Figure 3A:
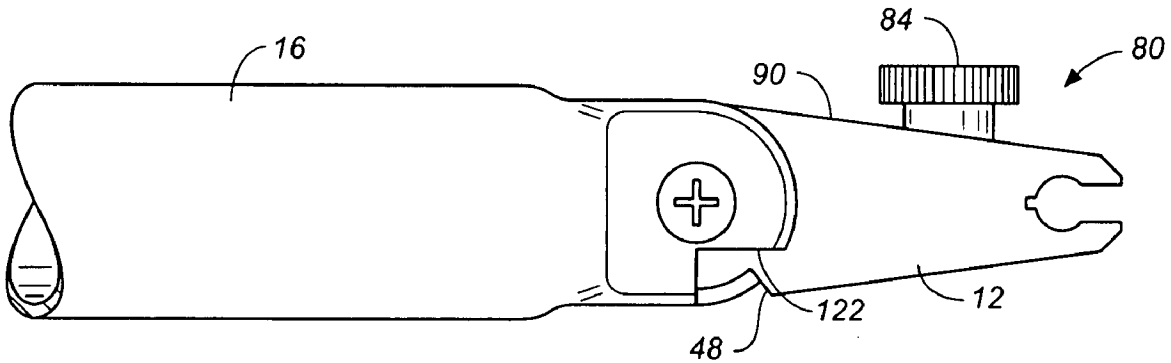
FIG. 3A is a side plan view of a pivoting squeegee according to the invention with the handle truncated, and showing the head in the biased position relative to the handle.
Figure 3B:
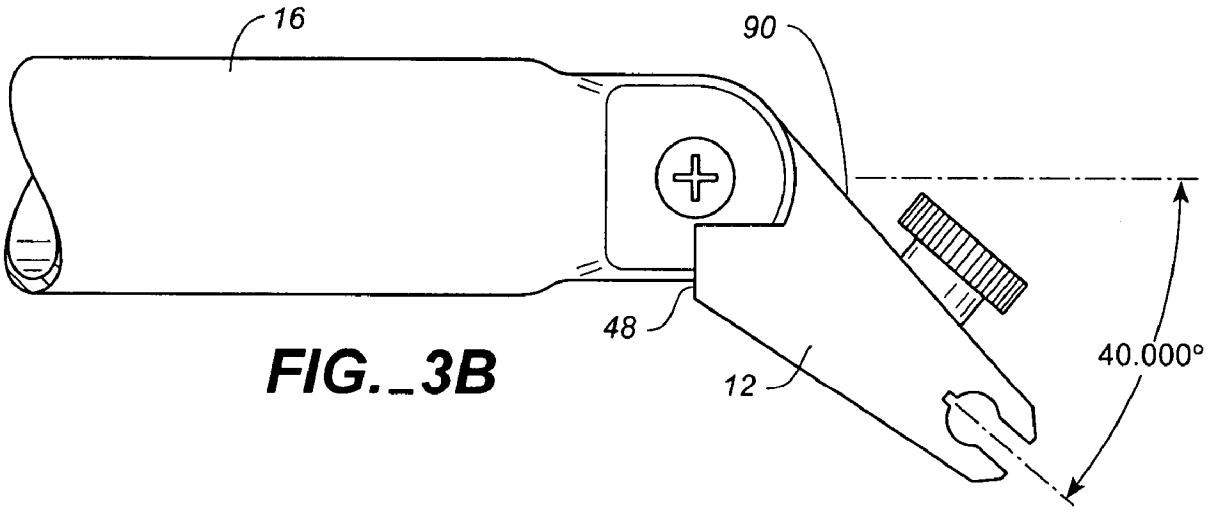
FIG. 3B is a side plan view of the pivoting squeegee of FIG. 3A, showing the head in the rest position relative to the handle.
Figure 4A:
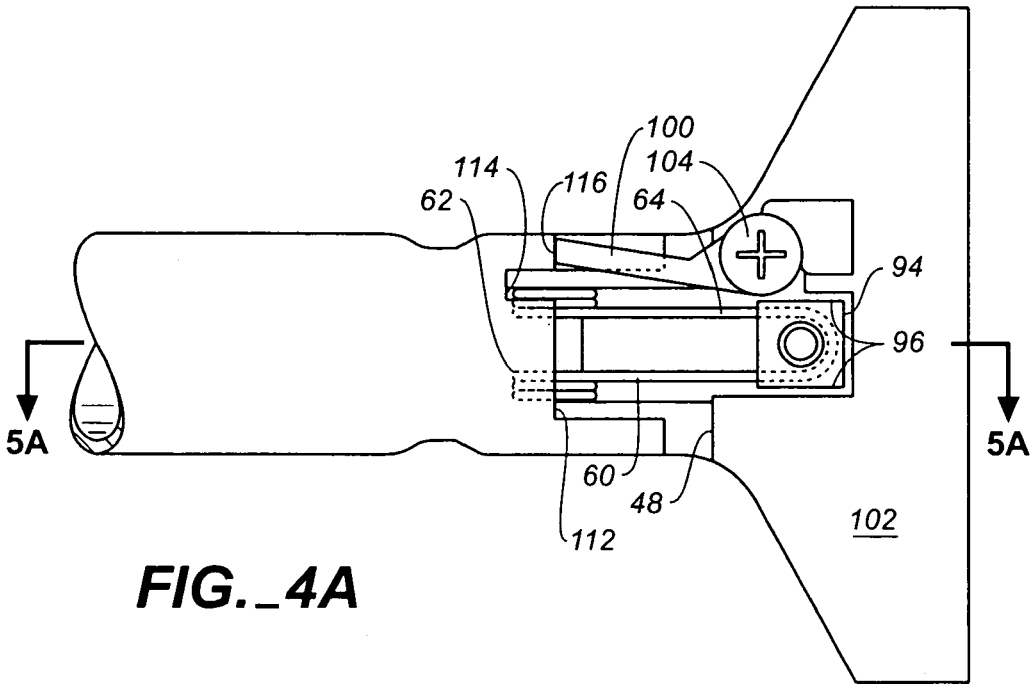
FIG. 4A is a bottom plan view of the invention with the handle truncated and showing the locking lever in the locked position.
Figure 4B:
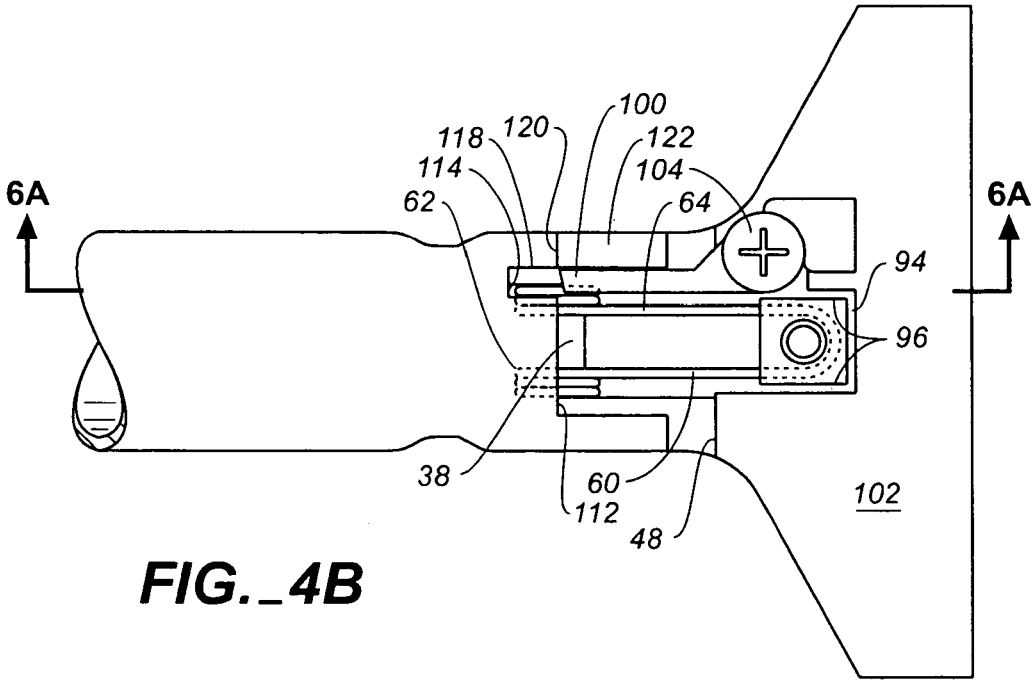
FIG. 4B is a bottom plan view of the invention shown in FIG. 4A, but with the locking lever shown in the unlocked position.

The pivoting head 12 of the squeegee is movable about the axis 42 between a rest position and a biased position in relation to the handle 16, as seen in FIGS. 3B and 3A, respectively. The rest position displaces the head 12, and thus the wiping blade 14, at an angle relative to the handle so that the wiping blade 14 may easily be held at an optimum angle to the glass for cleaning effectiveness. In the art the optimum angle is generally known to be about forty degrees, but this could vary by perhaps ten degrees. In the rest position, the head 12 is prevented from over-pivoting to a greater angle by abutment of collar 44 with the bottom edge 46 of one of the outer plates 30 on the handle 16 as shown in FIGS. 2A and 2B and by direct abutment of face 48 with shelf 112, as best seen by referring to FIGS. 2A, 2C, 5A, and 5B. Pivoting the head to the biased position seen in FIG. 3A positions the head in linear alignment with the handle, thus putting the wiping blade, head, and handle in overall planar alignment. The head 12 is prevented from over-pivoting beyond linear relation with the handle by juxtaposition of abutting wall 50 on the handle and the rear edge 52 of the top of the head 12, as shown in FIGS. 6A and 6B.

Reference to FIGS. 2A, 2C, 4A, 4B, 5A, and 5B show spring 60 fully contained inside the head 12 of the squeegee and biased toward the rest position. The spring 60 preferably comprises dual coils 62 which are looped around barrel nut 38 effectively capturing the spring at the axis of rotation 42. A U-shaped projection 64 extends forward from coils 62 into head 12. Rearward projections 66 extend up generally perpendicular to the U-shaped projection 64 and are held in tension against and in close proximity to dual backstops 68 of handle 16. Preferably each backstop 68 has a concave forward face 70 against which projections 66 are seated to restrict lateral movement. The U-shaped forward projection 64 is held in place in the head 12 by a tension adjustment mechanism described below.

Figure 5A:
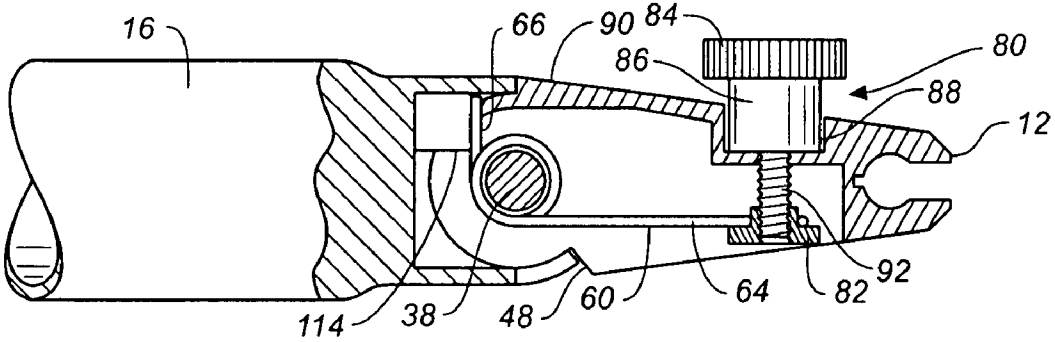
FIG. 5A is a side elevation view of a pivoting squeegee according to the invention, cutaway through the middle of the head to show the spring and tension adjustment mechanism and showing the head in the biased position relative to the handle.
Figure 5B:
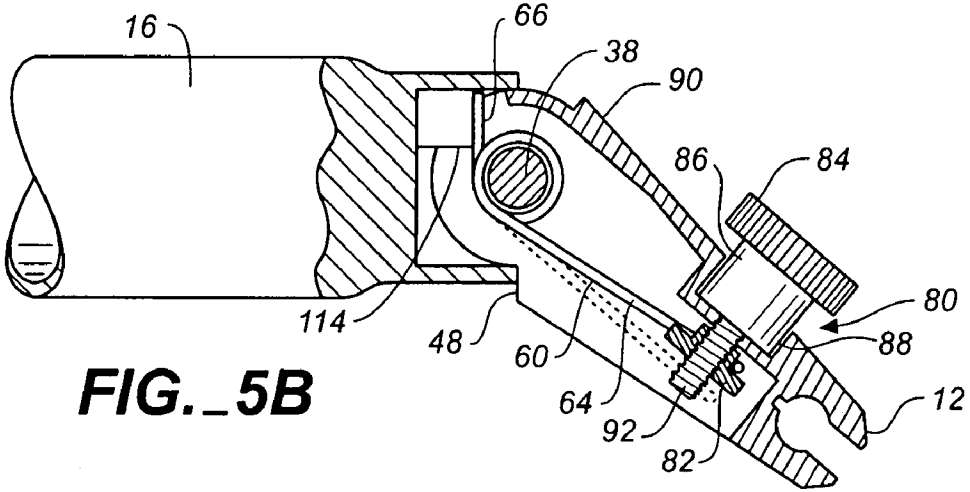
FIG. 5B is a side elevation view of the invention similar to that shown in FIG. 5A, but showing the head in the rest position relative to the handle.
Figure 6A:
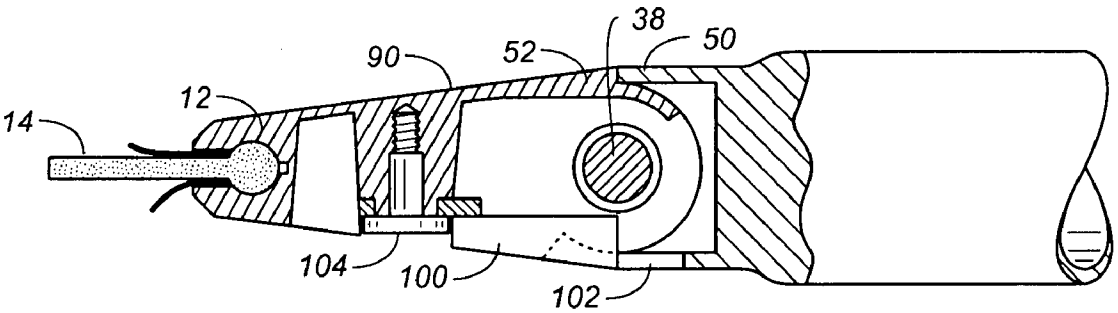
FIG. 6A is a side elevation view of the invention showing the head cutaway off-center to show the locking lever in the locked position and showing the head in the biased position relative to the handle.
Figure 6B:
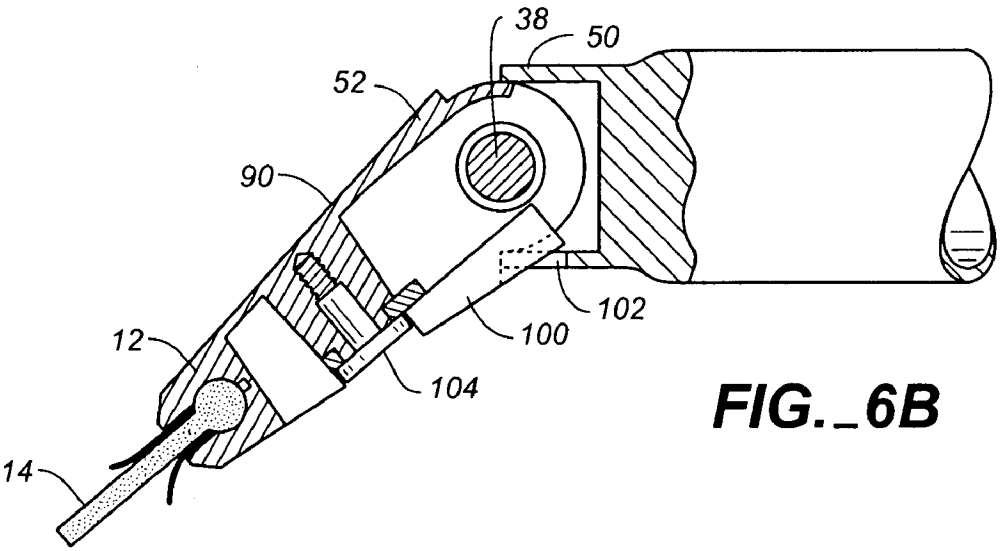
FIG. 6B is a side elevation view of the invention similar to that shown in FIG. 6A, but showing the locking lever in the unlocked position and showing the head in the rest position relative to the handle.

Referring to FIGS. 2C, 5A and 5B; it is seen that the tension adjustment mechanism comprises a tension adjustment knob 80 and tension adjustment nut 82. The tension adjustment knob 80 has a knurled top 84 to facilitate turning of the knob. A barrel fitting 86 extends from the knurled top 84 and is seated in recess 88 in the top surface 90 of head 12. The recess 88 is set at a depth appropriate to capture it in the head 12 against lateral movement, but sufficiently shallow that the knurled top 84 is retained at an accessible level above the top surface 90 of the head 12. A linear projection 92 extends from the barrel fitting 86 through head 12 and is in threaded engagement with the tension adjustment nut 82. The U-shaped projection 64 of the spring 60 passes around the linear projection 92 between the tension adjustment knob 80 and the tension adjustment nut 82 and is biased toward the tension adjustment nut 82 so that the tension adjustment knob 80 is retained in place in the head 12. The tension adjustment nut 82 is freely disposed in a rectangularly shaped internal shaft 94 in the head 12 with the squared edges 96 of the nut 82 in sufficient proximity to the walls of shaft 94 that, when the tension adjustment knob 80 is turned, nut 82 is prevented from turning but travels longitudinally in shaft 94. Accordingly, as shown by the shaded lines in FIG. 5B, as nut 82 is moved up or down by clockwise or counter-clockwise rotation of knob 80, the U-shaped projection 64 of the spring 60 moves up or down within head 12 to adjust the tension of the spring to a level appropriate to working conditions. Thus the invention provides a squeegee having the head 12 angularly displaced from the handle 16 in a rest position and held in the rest position by spring tension. The head is movable to a biased position by pressure bearing against the spring when needed. The head pivots back to the rest position when the pressure is released.

Although the preferred embodiment of the invention provides for the dual coiled spring 60 described above, alternative embodiments of the invention could provide a single coil spring or a plurality of coiled springs. In other embodiments, leaf or helical springs could be adapted to use.

Referring now to FIGS. 2C, 4A, 6A and 6B, a locking lever 100 is attached to head 12 but is recessed such that the lever 100 is generally flush with the lower surface 102 of the head. Screw 104 is threaded through retention ring 106 of lever 100 into aperture 108 in head 12 for pivoting movement of the lever 100 about an axis perpendicular to head 12. Wave washer 110 is provided between the head of screw 104 and ring 106 so that, when screw 104 is backed off slightly from a fully tightened configuration, lever 100 is rotatable between a locking position and an unlocked position, but is held in limited tension sufficient to retain the lever 100 in the last position to which it was moved. When the head 12 is moved into the biased position relative to the handle 16, the locking lever 100 can be moved into the locking position seen best in 4A. In the locking position the rear face 116 of the locking lever 100 is in abutment with the forward-facing surface 120 of cutout 122 in outer plate 30. The rear face 116 and forward-facing surface 120 are in compressed abutment resulting from the bias of the head 12 toward the rest position. The locking lever 100 is retained in place by head-to-head abutment with forward-facing surface 120 and lateral abutment with collar 44. However, with slight back pressure on head 12, the lever 100 can be pivoted from the locking position to the unlocked position shown in FIG. 4B. A notch 118 is provided in handle 16 through which the lever passes as head 12 pivots to the rest position shown in FIG. 6B.

Figure 7B:
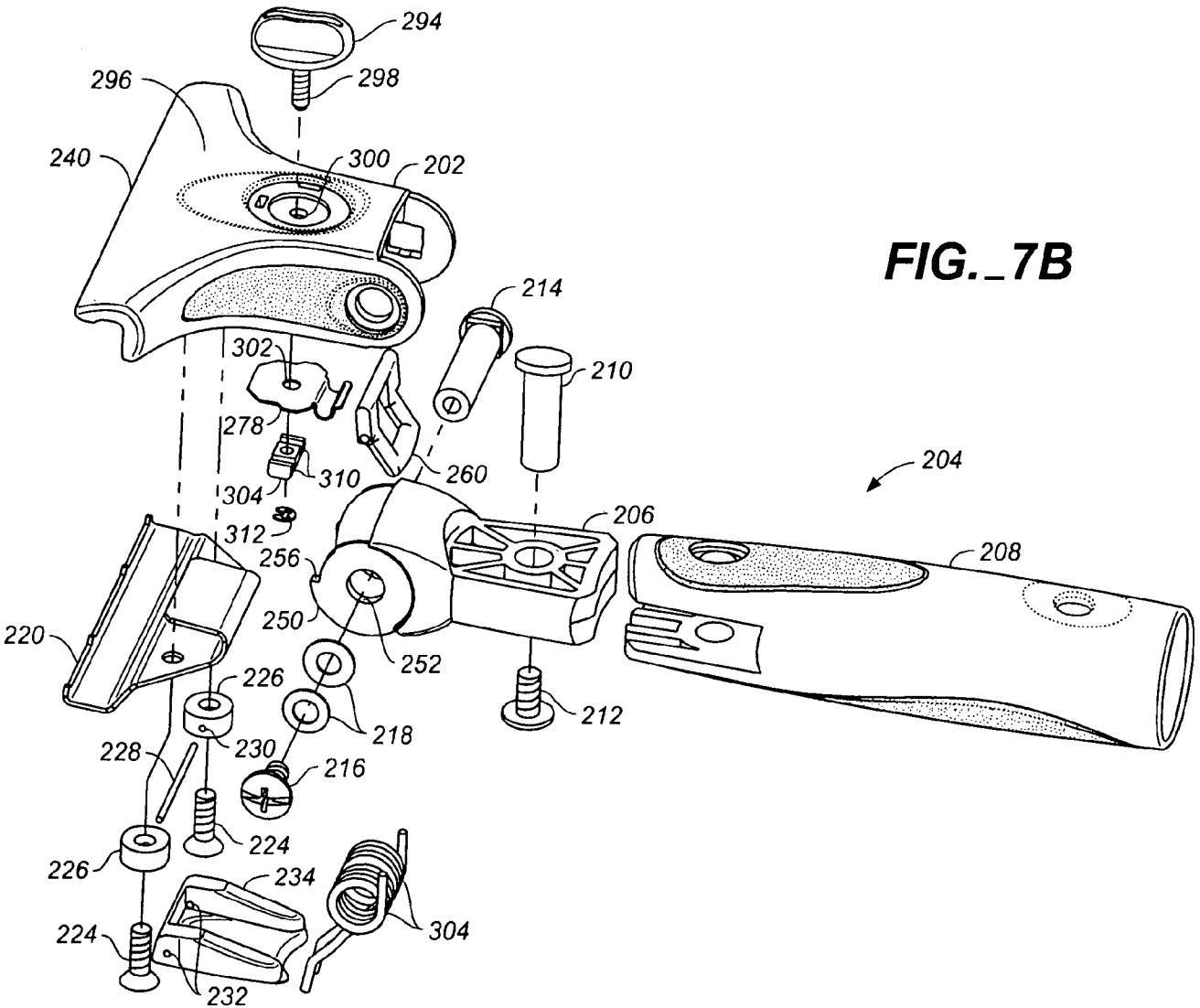
FIG. 7B is an exploded view of the squeegee shown in FIG. 7A.

With reference now to FIGS. 7A and 7B, a second embodiment of the invention, generally indicated at 200, includes a head 202 and handle 204. The handle 204 includes a knuckle 206 that is pivotally attached to a main handle body 208 with a first shoulder nut 210 and cooperating first retaining screw 212 to permit the handle body 208 to swivel laterally relative to the knuckle 206 about a first axis coincident with the shoulder nut 210. The head 202 is attached to the knuckle 206 by a second shoulder nut 214 for pivoting motion about a second axis perpendicular to the first axis. The shoulder nut 214 is preferably held in place with a second retaining screw 216 and washers 218. It will be readily appreciated that the handle main body 208, knuckle 206 and head 202 may be pivotally attached by a myriad of mechanisms known in the art.

A channel clip 220 is attached to the head 202 by threaded fasteners 224 as seen in FIG. 7B. A pin retainer 226 is interposed between the head of each fastener 224 and the squeegee head 202. The pin retainers 226 in turn hold in place a latch pin 228 each end of which is embedded in opposing holes 230 in the pin retainers. The latch pin 228 is rotatably inserted in pin holes 232 in each side of a beveled latch 234 such that the latch 234 is pivotally retained against the underside of the channel clip 220. See also FIGS. 9A–9C. The channel clip 220 includes an upwardly and forwardly extending flexible tail 236 in biased contact directly with the head 202. The latch 234 works like a cam and is pivotable between a compressing position seen in FIG. 9A–9C and a release position (not illustrated) in which it is pivoted away from the head. In the compressing position a wiping blade 238 is tightly held between the forward portion 240 of the head and the channel clip 220. Conversely, when the latch 234 is moved to the release position, tension on the channel clip 220 is relaxed sufficiently for the wiper blade 238 to be removed for installation of a new blade.

With continuing reference to FIG. 7B, the forward portion of the knuckle 206 includes two generally parallel side plates 250. The shoulder nut 214 is inserted through concentric holes 252 in the side plates 250 to form the axis for pivoting the head 202 between biased and rest positions seen respectively in FIGS. 9A and 9C. Each side plate 250 includes a generally arcuate recessed forward portion 254 forming at its lower part an upward facing ledge 256. See FIG. 11. A generally square-shaped lock lever 260 is attached to the top wall 262 of a downward facing recess 264 in the head 240 of the squeegee. The lock lever 260 is comprised of a cylindrical crossbar 266, a pair of legs 268 depending from the crossbar, and a bridge 270 extending between the legs opposite the crossbar. The bridge 270, legs 268 and crossbar 266 define an intermediate opening 272. Each leg 268 has a base portion 274 extending laterally adjacent the crossbar. The base portion includes a stop surface 276 facing downward and away from the top wall 262 of the recess 264. The crossbar 266 of the lock lever 260 is held in pivotable disposition against the top wall 262 by a retainer 274 so that the crossbar 266 forms a pivot axis around which the lock lever 260 is free to pivot between a locked position as seen in FIG. 9A and a released position shown in broken lines in FIG. 9A. In the locked position, with the head of the squeegee in the biased position in linear alignment with the handle as shown in FIGS. 9A and 9B, the base portions 274 of the legs 268 are interposed between the top wall 262 of the recess 264 and the upward facing ledges 256 of the side plates 250 thus disposing the stop surfaces 276 of the base portions 274 against the ledges 256 of the side plates 250 thereby preventing the head 202 from rotating from the biased position to the rest position. In the illustrated embodiment, each of the lower parts of the recessed forward portion 254 of the side plates 250 has a forward facing edge 275 which intersects with the upward facing ledge 256. When the lock lever 260 is in the locked position, the forward facing edge 275 of the abuts a rear edge 276 of the lock lever 260. See FIG. 9A. Relative to the pivot axis of the lock lever 260, the ledge 256 forms a slightly acute angle as shown in FIG. 11. Preferably the angle is three degrees, but could range approximately from one to fifteen degrees. Biasing the stop surfaces 276 of the lock lever 260 against the ledges 256, forces the stop surfaces towards the side plates 250 and into the intersection of the ledges 256 and forward facing edges 275 to capture the lock lever 260 against the side plate 250. Upward pressure on the head will relieve the biasing pressure of the stop surfaces 276 against the ledges 256 freeing lock lever 260 to be pivoted to the released position. This in turn moves the base portions 274 of the lock lever sufficiently to release the head 202 to pivot to the rest position.

Referring now to FIGS. 10A–10C, the retainer 278 is generally planar and has a forward edge 280, two side edges 282 orthogonal to the forward edge, and an upward opening channel 284 opposite the forward edge. The two side edges 282 span the width of the retainer 278. A forward flange 286 and two side flanges 288 orthogonal to the forward flange depend downwardly from the top wall 262 of the recess 264, the side flanges 288 spaced apart by the width of the retainer 278. Each of the flanges 282, 284 has an inwardly extending tab that is downwardly spaced from the top wall 262. The forward edge 280 of the retainer 278 is held against the forward flange 286 between the top wall 262 and a side tabs 292 on the forward flange 286. Similarly, the side edges 282 of the retainer are held against the inner edges of the side flanges 288 between the top wall 262 and a pair of side tabs 292 on the side flanges 288. The retainer 278 is thus held against the top wall 262 between the forward 282 and side flanges 288. As shown in FIGS. 9A–9C, the crossbar 266 of the lock lever 260 is held in the retainer's channel 284 against the top wall 262 of the recess 264.

An adjustment knob 294 is rotatably disposed on the top surface 296 of the head 202. A post 298 depending from the knob 292 is disposed and freely rotatably in a hole 300 in the top of the head (See FIG. 7B) and in an aperture 302 in the retainer 278 (see FIG. 10A) in concentric alignment with the hole 300. A spring pull nut 304 is threadedly attached to the post 298 such that rotation of the adjustment knob 294 moves the spring pull nut 304 towards or away from the adjustment knob. The retainer 278 is prevented from rotating in its own plane from rotation of the post 298 due to the tight disposition of its forward 277 and side edges 282 against the forward 282 and side flanges 288 of the top wall 262. In this embodiment two springs 306 are coiled around the axis post 214. A forward projection 308 extends from each spring 306 through the opening 268 in the lock lever 260. The forward projection 308 of each spring 306 is downwardly hooked and sits in downwardly biased engagement in oppositely disposed depressions 310 in the spring pull nut 304 laterally of the post 298. The spring tension is thus adjustable by rotation of the adjustment knob 294 raise and lower the forward projections 308 to achieve a desired comfort level. An e-clip 312 attached to the bottom of the post 298 prevents the post from being unscrewed and detached from the spring pull nut 304.

Figure 8C:
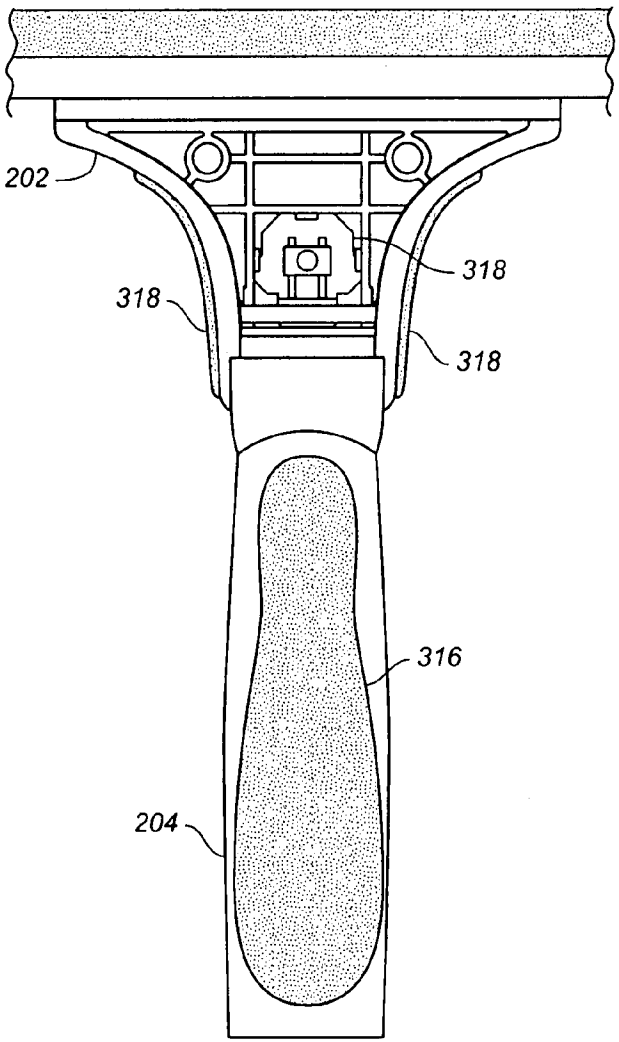
FIGS. 8A–8C are side, top and bottom views, respectively, of the squeegee shown in FIG. 7A. The wiping blade, channel and channel clip have been removed from FIG. 8C to expose the retainer, spring pull nut, and forward projections of the two springs.
Figure 8B:
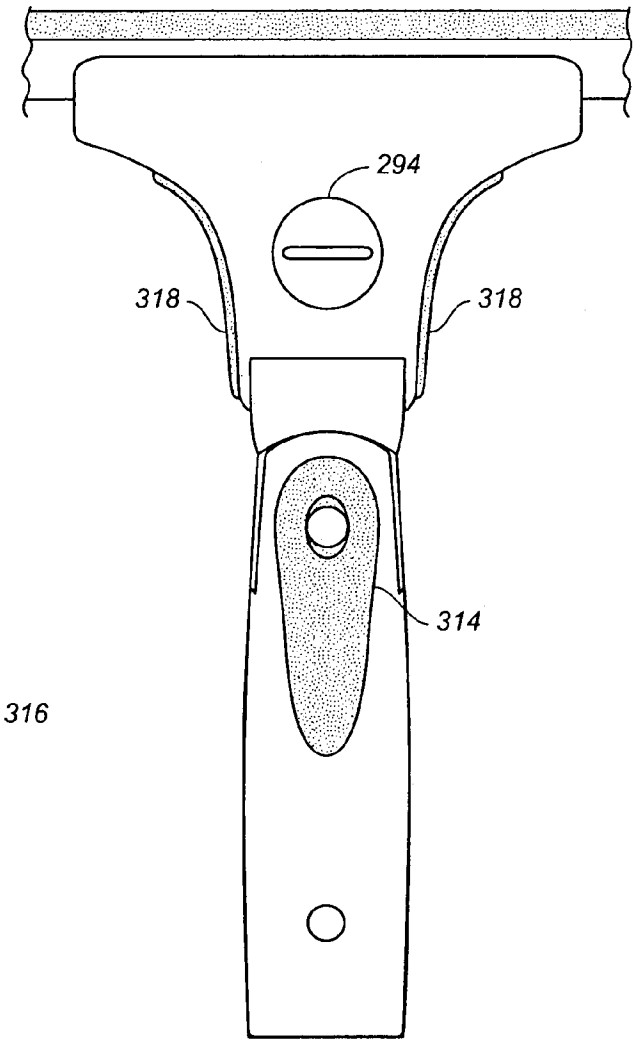
Figure 8A:
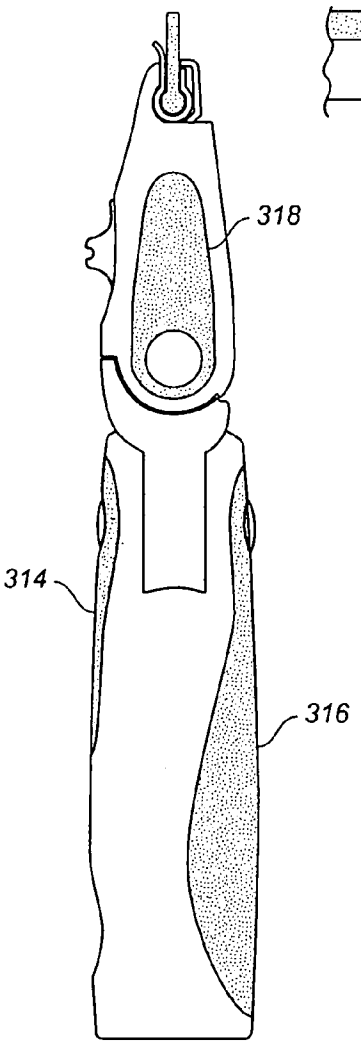

With reference now to FIGS. 8A–8C, a squeegee according to the invention includes strategically placed slip-resistant surfaces on the handle and head to assist in manipulation of the device. A top insert 314 on the handle provides a slip-resistant top surface for the palm of a hand. See FIG. 12B. A bottom insert 316 provides a slip-resistant undersurface for one or more fingers. See FIG. 12A. Two side inserts 318 provide oppositely facing slip-resistant side surfaces for gripping by a thumb and opposing finger or fingers as also shown in FIGS. 12A and 12B. The slip-resistant surfaces provide improved handling as downward pressure bearing on the top of the handle simultaneously with upward pressure on the bottom of the handle is used to move the head from the rest position to the biased position. Similarly, the slip-resistant surfaces on the head provide improved "fingertip" control as the squeegee is worked from side-to-side over a window. Preferably the slip resistant surfaces comprise overmolding inserts set into recesses in the handle and head. However, it will be readily appreciated that slip-resistant surfaces would be attached to the head and handle surfaces using adhesives with or without recesses.

In normal operation and in most circumstances the invention should be used like a conventional squeegee. After wetting the window surface with water or a cleaning solution, the squeegee is applied to the surface at an edge of the window generally with one end of the squeegee blade disposed in a corner of the window. The squeegee's wiping blade is then swept across all parts of the window surface where an optimal cleaning angle can be sustained with the head in the rest position. However, when cleaning recessed windows, as the squeegee blade is being drawn to a corner or edge adjacent an abutting wall, deep window frame or window ledge, forward pressure on the handle combined with continuing downward pressure on the wiping blade will pivot the head of the squeegee from the rest position into the biased position. When the head is in the biased position, the wiping blade of the squeegee can be maintained at an optimum cleaning angle to the glass surface even if the handle, head, and wiping blade are all in linear disposition and the handle is perpendicular to the window. Therefore, recessed windows can be wiped clean with the invention in a single continuous stroke rather than by the inefficient methods of removing the squeegee from the window and starting a new stroke or by hand wiping the remaining uncleaned portion of the window. In situations where windows reachable only with poles are also recessed, the invention eliminates the need to retract the pole, wipe the blade, then re-extend the pole for a second stroke. Similarly, when tall ground level windows are being cleaned using pole-mounted squeegees, the locking lever may set the head in the biased position such that the squeegee may be drawn down the entire height of the window to ground level in a single stroke while retaining the wiping blade at an optimal angle to the window surface.

There have thus been described and illustrated certain preferred embodiments of a spring-biased pivoting squeegee according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

We claim:

1. A pivoting head squeegee having a locking mechanism, the squeegee of the type having a head having a laterally extending forward portion, a downward facing recess, and a top wall bounding the recess, the forward portion for mounting a wiping blade, and a handle, the head pivotally attached to the handle about an axis parallel with the forward portion, the head movable about the axis between a rest position and a biased position, the head in the rest position angularly displaced relative to the handle, and the head in the biased position disposed in general planar relation with the handle, the locking mechanism comprising:

at least one spring disposed about the axis, said spring having a forward projection extending from the axis, said forward projection affixed to the head and biased towards the rest position, the handle having two spaced apart side plates in perpendicular disposition relative to the axis, each said plate having a recessed forward edge portion defining a ledge facing the top wall of the recess, a lock lever disposed in the recess of the head, said lock lever having a crossbar, and a pair of spaced apart legs depending from said crossbar, said legs each having a laterally extending base portion having a stop surface facing away from the top wall of the recess, and a retainer holding said lock lever against the top wall of the recess, said lock lever pivotable about said crossbar between a locked position and a released position, wherein in said locked position the head is in the biased position and said base portion of said legs of said lock lever are interposed between the top wall of the recess and said ledges of said side plates, said interposition disposing said ledges of said side plates in biased abutment with said stop surfaces of said lock lever.

2. The pivoting head squeegee having a locking mechanism of claim 1 wherein:

said at least one spring comprises two springs.

3. The pivoting head squeegee having a locking mechanism of claim 1 wherein:

said lock lever further comprises a bridge extending between said distal end of said legs, said bridge exposed for manual manipulation of said lock lever.

4. The pivoting head squeegee having a locking mechanism of claim 1 wherein:

said recessed forward edge portions of said side plates each have a lower edge intersecting with said ledge, and said base portions of said legs of said lock lever each have a rear edge for abutment with said lower edge when said lock lever is in said locked position, said stop surface of said base portion of each said leg disposed in a plane disposed acutely to said rear edge such that biased abutment of said stop surfaces and said ledges urges said rear edges of said base portions of said legs towards said lower edges of said recessed forward edge portions of said side plates.

5. The pivoting head squeegee having a locking mechanism of claim 1 wherein:

the forward projection of the at least one spring is interposed between said legs of said lock lever.

6. The pivoting head squeegee having a locking mechanism of claim 1 wherein:

said retainer has a forward edge, side edges orthogonal to said forward edge defining between them a width of said retainer, and an upward opening channel opposite said forward edge, said top wall of said recess has a downwardly facing forward flange and two side flanges orthogonal to said forward flange, said side flanges spaced apart a distance approximately equivalent to said width of said retainer, said forward and side flanges each having at least one inwardly extending tab spaced from said top wall, said forward edge of said retainer disposed against said forward flange, said side edges of said retainer disposed against said side flanges, and said forward and side edges are disposed between said top wail and said tabs such that said retainer is held against said top wall of said recess and between said flanges and so that said flanges restrict rotation of said retainer, and said crossbar of said lock lever is retained in said channel against said top wall.

7. The pivoting head squeegee having a locking mechanism of claim 6 wherein:

said forward flange extends in parallel relation to said axis and said forward edge of said retainer is linear.

8. The pivoting head squeegee having a locking mechanism of claim 6 further comprising:

said retainer having an aperture between said side edges, said top wall of said head having a hole in concentric alignment with said aperture, and a post attached to said head, said post mutually received in said aperture and in said hole transversely to said top wall for restricting lateral movement of said retainer relative to said top wall.

9. The pivoting head squeegee having a locking mechanism of claim 8 further comprising:

a knob and a spring pull nut, said head having a top surface, said knob rotatably disposed on said top surface, said post attached to and depending from said knob, said spring pull nut having a threaded center bore, said post threadedly inserted and freely rotatable in said center bore, and each forward projection of said at least one springs in biased engagement with said spring pull nut such that rotation of said knob moves said spring pull nut towards or away from said top wall to increase or decrease the tension of said at least one spring.

10. A pivoting head squeegee having a locking mechanism, the squeegee of the type having a head having a laterally extending forward portion, a downward facing recess, and a top wall bounding the recess, the forward portion for mounting a wiping blade, a handle, the head pivotally attached to the handle about an axis parallel with the forward portion, the head movable about the axis between a rest position and a biased position, the head in the rest position angularly displaced relative to the handle, and the head in the biased position disposed in general planar relation with the handle, and at least one spring disposed about the axis, the spring having a forward projection extending from the axis, the forward projection affixed to the head and biased towards the rest position, the locking mechanism comprising:

the handle having two spaced apart side plates in perpendicular disposition relative to the axis, each said plate having a recessed forward edge portion defining a ledge facing said top wall of the recess, a lock lever disposed in the recess of said head, said lock lever having a crossbar, and a pair of spaced apart legs depending from said crossbar, said legs each having a laterally extending base portion having a stop surface facing away from the top wall of the recess, and a retainer having a forward edge, side edges orthogonal to said forward edge defining between them a width of said retainer, and an upward opening channel opposite said forward edge, the top wall of the recess having a downwardly facing forward flange and two side flanges orthogonal to said forward flange, said side flanges spaced apart a distance approximately equivalent to the width of said retainer, said forward and side flanges each having at least one inwardly extending tab spaced from said top wall, said forward edge of said retainer disposed against said forward flange, said side edges of said retainer disposed against said side flanges, and said forward and side edges disposed between said top wall and said tabs such that said retainer is held against said top wall of said recess and between said flanges and so that said flanges restrict rotation of said retainer, said crossbar of said lock lever retained in said channel against said top wall, and said lock lever pivotable about said crossbar between a locked position and a released position, wherein in said locked position said head is in said biased position and said base portion of said legs of said lock lever are interposed between said top wall of said recess and said ledges of said side plates, said interposition disposing said ledges of said side plates in biased abutment with said stop surfaces of said lock lever.

11. A pivoting head squeegee having a locking mechanism, the squeegee of the type having a head having a laterally extending forward portion, a downward facing recess, and a top wall bounding the recess, the forward portion for mounting a wiping blade, a handle, the head pivotally attached to the handle about an axis parallel with the forward portion, the head movable about the axis between a rest position and a biased position, the head in the rest position angularly displaced relative to the handle, and the head in the biased position disposed in general planar relation with the handle, and at least one spring disposed about the axis, the spring having a forward projection extending from the axis, the forward projection affixed to the head and biased towards the rest position, the locking mechanism comprising:

the handle having two spaced apart side plates in perpendicular disposition relative to the axis, each said plate having a recessed forward edge portion defining a ledge facing the top wall of the recess, a lock lever disposed in the recess of the head, said lock lever having a crossbar, a pair of spaced apart legs depending from said crossbar, and a bridge, said legs each having a distal end, said bridge extending between said distal ends of said legs, and said legs each having a laterally extending base portion having a stop surface facing away from the top wall of the recess, at least two springs disposed about the axis, said springs each having a forward projection extending from the axis and interposed between said legs of said lock lever, a retainer having a forward edge, side edges orthogonal to said forward edge defining between them a width of said retainer, an aperture between said side edges, and an upward opening channel opposite said forward edge, said top wall of said head having a downwardly facing forward flange, said forward flange extending in parallel relation to said axis, said top wall further having two side flanges orthogonal to said forward flange, said side flanges spaced apart by approximately said width of said retainer, said forward and side flanges each having at least one inwardly extending tab spaced from said top wall, said forward edge of said retainer disposed against said forward flange, said side edges of said retainer disposed against said side flanges, and said forward and side edges disposed between said top wall and said tabs such that said retainer is held against said top wall of said recess and between said flanges and so that said flanges restrict rotation of said retainer, said crossbar of said lock lever retained in said channel against said top wall, and said lock lever pivotable about said crossbar between a locked position and a released position, wherein in said locked position said head is in said biased position and said base portion of said legs of said lock lever are interposed between said top wall of said recess and said ledges of said side plates, said interposition disposing said ledges of said side plates in biased abutment with said stop surfaces of said lock lever, and a knob and a spring pull nut, said knob rotatably disposed on said top surface of said head, a post attached to and depending from said knob, said post transversely received in said aperture of said retainer and in said hole of said top wall for restricting lateral movement of said retainer relative to said top wall, said spring pull nut having a threaded center bore, said post threadedly inserted and freely rotatable in said center bore, each forward projection of said at least two springs in biased engagement with said spring pull nut such that rotation of said knob moves said spring pull nut towards or away from said top wall to increase or decrease the tension of said at least two springs.

12. A pivoting head squeegee having a locking mechanism comprising:

a head having a laterally extending forward portion, a downward facing recess, and a top wall bounding said recess, said forward portion for mounting a wiping blade, a handle, said head pivotally attached to said handle about an axis parallel with said forward portion, said handle having two spaced apart side plates in perpendicular disposition relative to said axis, each said plate having a recessed forward edge portion defining a ledge facing said top wall of said recess, said head movable about said axis between a rest position and a biased position, said head in said rest position angularly displaced relative to said handle, and said head in said biased position disposed in general planar relation with said handle at least one spring disposed about said axis, said spring having a forward projection extending from said axis, said forward projection affixed to said head and biased towards said rest position, a lock lever disposed in said recess of said head, said lock lever having a crossbar, and a pair of spaced apart legs depending from said crossbar, said legs each having a laterally extending base portion having a stop surface facing away from said top wall of said recess, and a retainer holding said lock lever against said top wall of said recess, said lock lever pivotable about said crossbar between a locked position and a released position, wherein in said locked position said head is in said biased position and said base portion of said legs of said lock lever are interposed between said top wall of said recess and said ledges of said side plates, said interposition disposing said ledges of said side plates in biased abutment with said stop surfaces of said lock lever.

13. The pivoting head squeegee of claim 12 further comprising:

a wiping blade mounted on said forward portion transversely to said handle.

14. The pivoting head squeegee of claim 12 wherein:

said at least one spring comprises two springs.

15. The pivoting head squeegee of claim 12 wherein:

said head has a bottom side, and each said leg of said lock lever has a distal end, said lock lever further comprising a bridge extending between said distal end of said legs, said bridge exposed on said bottom side for manual manipulation of said lock lever.

16. The pivoting head squeegee of claim 12 wherein:

said recessed forward edge portions each have a forward facing edge intersecting with said ledge, and said base portions of said legs of said lock lever each have a rear edge for abutment with said forward facing edge when said lock lever is in said locked position, said stop surface of said base portion of each said leg intersecting acutely with said rear edge such that biased abutment of said stop surfaces and said ledges biases said rear edges of said legs towards said forward facing edges of said recessed forward edge portions of said side plates.

17. The pivoting head squeegee of claim 12 wherein:

said forward projection of said at least one spring is interposed between said legs of said lock lever.

18. The pivoting head squeegee of claim 12 wherein:

said retainer has a forward edge, side edges orthogonal to said forward edge defining between them a width of said retainer, and an upward opening channel opposite said forward edge, said top wall of said recess having a downwardly facing forward flange and two side flanges orthogonal to said forward flange, said side flanges spaced apart a distance approximately equivalent to said width, said forward and side flanges each having at least one inwardly extending tab spaced from said top wall, said forward edge of said retainer disposed against said forward flange, said side edges of said retainer disposed against said side flanges, and said forward and side edges are disposed between said top wall and said tabs such that said retainer is held against said top wall of said recess and between said flanges and so that said flanges restrict rotation of said retainer, and said crossbar of said lock lever is retained in said channel against said top wall.

19. The pivoting head squeegee of claim 18 wherein:

said forward flange extends in parallel relation to said axis and said forward edge of said retainer is linear.

20. The pivoting head squeegee of claim 18 further comprising:

said retainer having an aperture between said side edges, said top wall of said head having a hole concentrically aligned with said aperture, a post mutually received in said aperture and in said hole transversely to said top wall for restricting lateral movement of said retainer relative to said top wall, said post attached to said head.

21. The pivoting head squeegee of claim 20 further comprising:

a knob and a spring pull nut, said head having a top surface, said knob rotatably disposed on said top surface, said post attached to and depending from said knob, said spring pull nut having a threaded center bore, said post threadedly inserted and freely rotatable in said center bore, and each forward projection of said at least one springs in biased engagement with said spring pull nut such that rotation of said knob moves said spring pull nut towards or away from said top wall to increase or decrease the tension of said at least one spring.

22. A pivoting head squeegee having a locking mechanism comprising:

a head having a laterally extending forward portion, a downward facing recess, and a top wall bounding said recess, said forward portion for mounting a wiping blade, a handle, said head pivotally attached to said handle about an axis parallel with said forward portion, said handle having two spaced apart side plates in perpendicular disposition relative to said axis, each said plate having a recessed forward edge portion defining a ledge facing said top wall of said recess, said head movable about said axis between a rest position and a biased position, said head in said rest position angularly displaced relative to said handle, and said head in said biased position disposed in general planar relation with said handle, at least one spring disposed about said axis, said spring having a forward projection extending from said axis, said forward projection affixed to said head and biased towards said rest position, a lock lever disposed in said recess of said head, said lock lever having a crossbar, and a pair of spaced apart legs depending from said crossbar, said legs each having a laterally extending base portion having a stop surface facing away from said top wall of said recess, and a retainer having a forward edge, side edges orthogonal to said forward edge, and an upward opening channel opposite said forward edge, said top wall of said recess having a downwardly facing forward flange and two side flanges orthogonal to said forward flange, said side flanges spaced apart a distance approximately equivalent to the distance between said side edges of said retainer, said forward and side flanges each having at least one inwardly extending tab spaced from said top wall, said forward edge of said retainer disposed against said forward flange, said side edges of said retainer disposed against said side flanges, and said forward and side edges disposed between said top wall and said tabs such that said retainer is held against said top wall of said recess and between said flanges and so that said flanges restrict rotation of said retainer, said crossbar of said lock lever retained in said channel against said top wall, and said lock lever pivotable about said crossbar between a locked position and a released position, wherein in said locked position said head is in said biased position and said base portion of said legs of said lock lever are interposed between said top wall of said recess and said ledges of said side plates, said interposition disposing said ledges of said side plates in biased abutment with said stop surfaces of said lock lever.

23. A pivoting head squeegee having a locking mechanism comprising:

a head having a laterally extending forward portion, a downward facing recess, a top wall bounding said recess, and a top surface, said forward portion for mounting a wiping blade, a handle, said head pivotally attached to said handle about an axis parallel with said forward portion, said handle having two spaced apart side plates in perpendicular disposition relative to said axis, each said plate having a recessed forward edge portion defining a ledge facing said top wall of said recess, said head movable about said axis between a rest position and a biased position, said head in said rest position angularly displaced relative to said handle, and said head in said biased position disposed in general planar relation with said handle, a lock lever disposed in said recess of said head, said lock lever having a crossbar, a pair of spaced apart legs depending from said crossbar, and a bridge, said legs each having a distal end, said bridge extending between said distal ends of said legs, and said legs each having a laterally extending base portion having a stop surface facing away from said top wall of said recess, at least two springs disposed about said axis, said springs each having a forward projection extending from said axis and interposed between said legs of said lock lever, a retainer having a forward edge, side edges orthogonal to said forward edge defining between them a width of said retainer, an aperture between said side edges, and an upward opening channel opposite said forward edge, said top wall of said head having a downwardly facing forward flange, said forward flange extending in parallel relation to said axis, said top wall further having two side flanges orthogonal to said forward flange, said side flanges spaced apart by approximately said width of said retainer, said forward and side flanges each having at least one inwardly extending tab spaced from said top wall, said forward edge of said retainer disposed against said forward flange, said side edges of said retainer disposed against said side flanges, and said forward and side edges disposed between said top wall and said tabs such that said retainer is held against said top wall of said recess and between said flanges and so that said flanges restrict rotation of said retainer, said crossbar of said lock lever retained in said channel against said top wall, and said lock lever pivotable about said crossbar between a locked position and a released position, wherein in said locked position said head is in said biased position and said base portion of said legs of said lock lever are interposed between said top wall of said recess and said ledges of said side plates, said interposition disposing said ledges of said side plates in biased abutment with said stop surfaces of said lock lever, and a knob and a spring pull nut, said knob rotatably disposed on said top surface of said head, a post attached to and depending from said knob, said post transversely received in said aperture of said retainer and in said hole of said top wall for restricting lateral movement of said retainer relative to said top wall, said spring pull nut having a threaded center bore, said post threadedly inserted and freely rotatable in said center bore, each forward projection of said at least two springs in biased engagement with said spring pull nut such that rotation of said knob moves said spring pull nut towards or away from said top wall to increase or decrease the tension of said at least two springs.

24. A pivoting head squeegee of the type having a head having a forward portion, the forward portion for mounting a wiping blade, a handle pivotally attached to the head about an axis parallel with the forward portion, the head movable about the axis between a rest position and a biased position, the head in said rest position angularly displaced relative to the handle, and the head in the biased position disposed in general planar relation with the handle, and a spring extending from the axis for urging the head towards the rest position, the slip-resistant pivoting head squeegee comprising:

the head having two oppositely facing slip-resistant side surfaces, said slip-resistant side surfaces for ergonomic engagement with a thumb and opposing finger during use of the squeegee, and the handle having a back end, a slip-resistant top surface and a slip-resistant bottom surface, said slip-resistant bottom surface extending towards said back end further than said slip-resistant top surface, said slip-resistant top surface and slip-resistant bottom surface for reducing slippage upon downward pressure bearing on said top surface by a palm and simultaneous upward pressure on said bottom surface by one or more fingers for moving the head from the rest position to the biased position against the biasing force of the spring.

25. The pivoting head squeegee of claim 24 wherein:

said slip-resistant side surfaces each comprise overmolding side inserts, said slip-resistant top surface comprises an overmolding top insert, and said slip-resistant bottom surface comprises an overmolding bottom insert.

26. The pivoting head squeegee of claim 25 wherein:

said overmolding side inserts each have an outward facing concave shape.

* * * * *